US008231935B2

(12) United States Patent
Ihara et al.

(10) Patent No.: US 8,231,935 B2
(45) Date of Patent: Jul. 31, 2012

(54) THERMAL TRANSFER PRINTING METHOD AND APPARATUS

(75) Inventors: Keiji Ihara, Kanagawa-ken (JP); Seiichi Tanabe, Tokyo-to (JP); Toshinori Takahashi, Kanagawa-ken (JP); Yoshitaka Suzuki, Saitama-ken (JP); Osamu Goto, Tokyo-to (JP)

(73) Assignee: JVC Kenwood Corporation, Yokohama-shi, Kanagawa (JP)

( * ) Notice: Subject to any disclaimer, the term of this patent is extended or adjusted under 35 U.S.C. 154(b) by 1228 days.

(21) Appl. No.: 12/003,126

(22) Filed: Dec. 20, 2007

(65) Prior Publication Data

US 2008/0152795 A1 Jun. 26, 2008

(30) Foreign Application Priority Data

Dec. 22, 2006 (JP) ..... P2006-345699
Feb. 23, 2007 (JP) ..... P2007-044144

(51) Int. Cl.
*B41M 3/12* (2006.01)

(52) U.S. Cl. ..... 427/148; 347/179; 347/187; 347/213; 400/120.01; 400/120.13; 400/700

(58) Field of Classification Search ..... 427/148; 347/179, 187, 213; 400/120.01, 120.13, 400/700

See application file for complete search history.

(56) References Cited

FOREIGN PATENT DOCUMENTS

JP 2002-211064 7/2002

OTHER PUBLICATIONS

Translation of JP 2002-211064, Jul. 31, 2002.*

* cited by examiner

*Primary Examiner* — Michael Cleveland
*Assistant Examiner* — Xiao Zhao
(74) *Attorney, Agent, or Firm* — Nath, Goldberg & Meyer; Jerald L. Meyer; Robert T. Burns

(57) ABSTRACT

Thermal transfer printing method and apparatus are provided to make initial character image data left on a spent ink ribbon illegible. In the method, after forming an initial character image $FGi_1$ on an ink layer 11*b* in black of the ink ribbon 11, a forefront position S1 of the ink layer 11*b* is aligned with a forefront position S2 of an intermediate transfer film 25. Then, overwrite character image data $UGD_1$ is applied on a thermal head 19 to produce a first superimpose character image $KG1i_1$ on the ribbon 11 and a first superimpose character image $KG1m_1$ on the film 25. After that, the forefront position S1 of the ink layer 11*b* is shifted from the forefront position S2 of the film 25 by a predetermined distance and further, the overwrite character image data $UGD_1$ is applied on the thermal head 19 to produce a second superimpose character image $KG2i_1$ on the ribbon 11 and a second superimpose character image $KG2m_1$ on the film 25. In this way, the initial character image data left on the ribbon 11 and the film 25 can be together brought into illegible condition.

7 Claims, 22 Drawing Sheets

PRIOR ART

A

FIG. 1A これら４桁毎の乱数に合致するＪＩＳコードに対応する文

B1

FIG. 1B

C1

FIG. 1C

B2

FIG. 1D

C2

FIG. 1E

A: Initial Image Data
B1, B2: Overwrite Image Data
C1, C2: Superimpose Image Data Ink Ribbon
11b
S1
KG1i1

Re-impressing of Data UGD1 on Thermal Head

KG2i1 After 2nd Printing of Superimpose Character Image
Shifting of Position S1 for S2 by X mm
X
Intermediate Transfer Film
S2
KG1m1

Feeding direction
X
S2
KG2m1 After 2nd Printing of Superimpose Character Image

Producing of Images $FGi_1$, $FGm_1$ by Printing Data $FGD_1$

Drafting of Data $UGD_1'$ by Detecting Character Area from $FGD_1$ and Reversing Character Area Producing of Images $KG1i_1'$, $KG1m_1'$ by Printing Data $UGD_1'$ on Images $FGi_1$, $FGm_1$ Ink Ribbon
11b
Alignment of Positions S1, S2
Intermediate Transfer Film
Feeding direction
S1
S2
日本ビクター社員証
八王子技術部
五十嵐
IGARASHI
〒192-8620 東京都八王子市新子安2435-15
FGi2
After Re-transferring Image FGm2 on Card Impressing of Data UGD2 on Thermal Head KG1i2 After 1st Printing of Superimpose Character Image
KG1m2 After 1st Printing of Superimpose Character Image

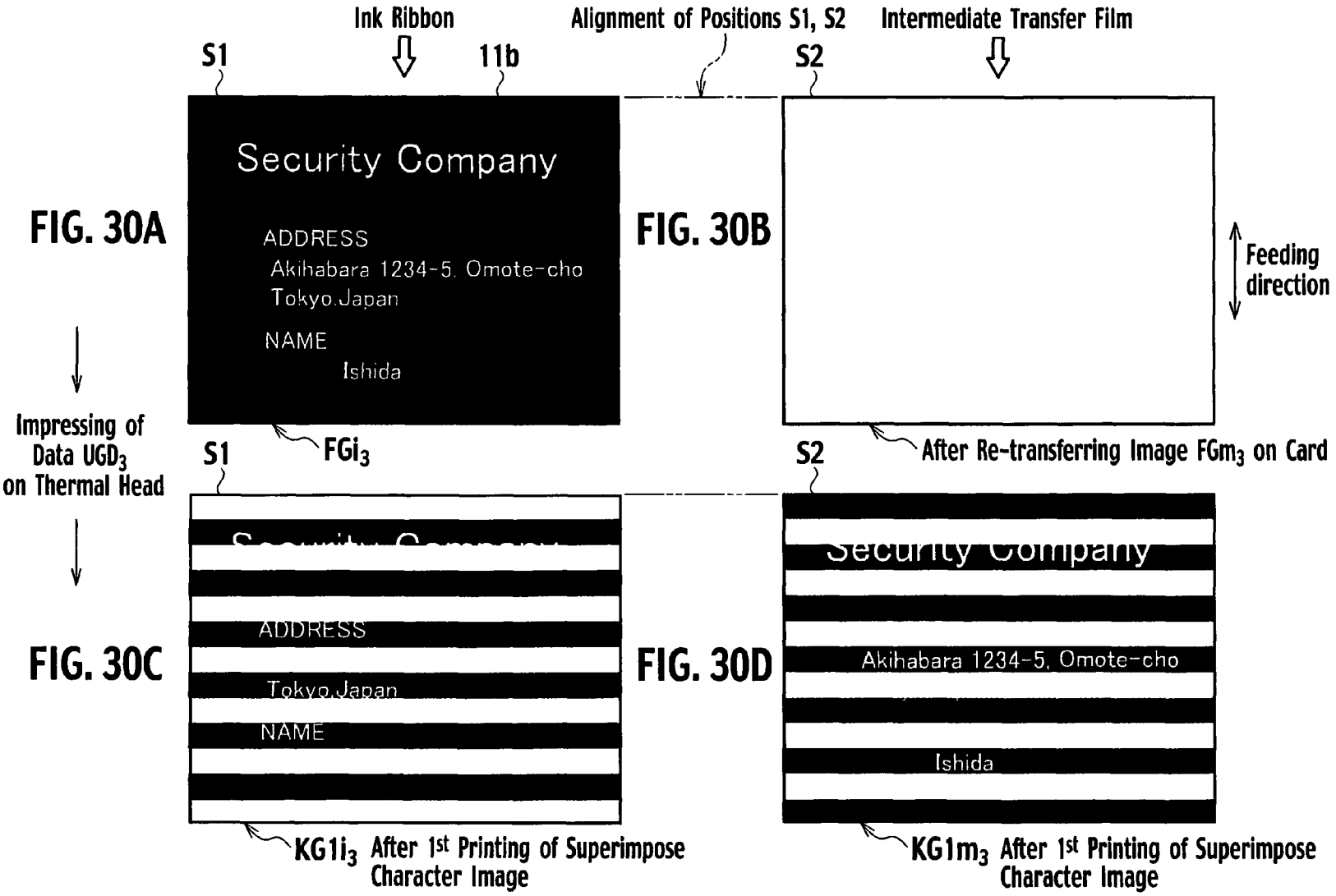
Ink Ribbon
11b
Alignment of Positions S1, S2
Intermediate Transfer Film
Feeding direction
S1
S2
Security Company
ADDRESS
Akihabara 1234-5, Omote-cho
Tokyo,Japan
NAME
Ishida
FGi3
After Re-transferring Image FGm3 on Card
FIG. 30A
FIG. 30B
Impressing of Data UGD3 on Thermal Head
ADDRESS
Tokyo,Japan
NAME
KG1i3 After 1st Printing of Superimpose Character Image
Akihabara 1234-5, Omote-cho
Ishida
KG1m3 After 1st Printing of Superimpose Character Image
FIG. 30C
FIG. 30D Ink Ribbon
11b
S1
ADDRESS
Tokyo,Japan
NAME
KG1i3

Shifting of Position S1 for S2 by P/2 mm
P/2
Intermediate Transfer Film
S2
Akihabara 1234-5, Omote-cho
Ishida
KG1m3
P
P Re-impressing of Data UGD3 on Thermal Head
S1
KG2i3
After 2nd Printing of Superimpose Character Image P/2
S2
KG2m3
After 2nd Printing of Superimpose Character Image Feeding direction

THERMAL TRANSFER PRINTING METHOD AND APPARATUS

BACKGROUND OF THE INVENTION

The present invention relates to a thermal transfer printing method of making an initial character image remaining on a spent ink ribbon illegible and a thermal transfer printing apparatus carrying out the above method.

With a heavy usage in this art, there is a thermal transfer printing apparatus that allows a thermal head having a plurality of heating resistive elements arranged in a main scan direction to transfer information to be printed, such as image information and character information, from a strip-shaped ink ribbon to a recording paper (or an intermediate transfer film) while feeding the ribbon and the paper (intermediate transfer film) in piles. In the printing apparatus, the ink ribbon has a strip-shaped ribbon base and a fusible or sublimation multicolor ink layer applied on the ribbon base. The multicolor ink layer consists of respective ink layers in yellow (Y), magenta (M), cyan (C) and black (BK) which are applied on the ribbon base repeatedly and respectively compartmentalized to have a predetermined size each in accordance with the recording paper (intermediate transfer film).

In this kind of thermal transfer printing apparatus, generally, sublimation dyes are used for respective colors yellow (Y), magenta (M) and cyan (C). In the thermal transfer operation, since such colors' transferred (or re-transferred) traces are remaining in the ink ribbon and the intermediate transfer film indistinctly, it is impossible for a third party to make out image information from these traces. Additionally, as these colors are mainly used for printing various images, they have a reduced degree of information secrecy in comparison with that of character information.

On the contrary, fusible pigments are generally used for black (BK) layers in the ink ribbon for purposes of printing of character information and bar-codes. Since such fusible pigments' transferred traces or re-transferred traces (reversed image) are remaining in the ink ribbon and the intermediate transfer film distinctly, it is possible for a third party to make out image information from these traces. It is especially noted that the character information contains information in high degree of secrecy frequently.

As for character information printed in black (BK), therefore, there is a fear of leakage of confidential information due to stolen spent ink ribbons and spent intermediate transfer films. When disposing of these spent ribbons and films, we have to apply any special treatment on them for preservation of confidentiality.

Japanese Patent Laid-Open Publication No. 2002-211064 discloses a transfer type image recorder capable of making initial images (initial image data) remaining on a spent ink ribbon illegible easily.

FIGS. 1A to 1E illustrate an initial image (initial image data), overwrite image data and a superimposed image (superimpose image data) respectively to explain the operation of making the initial image remaining on a spent ink ribbon illegible by the above transfer type image recorder.

In the transfer type image recorder of the publication, after transferring ink from the ink ribbon to a recording paper by a heat sensitive head while pinching the ink ribbon and the recording paper between the head and a platen roller, the heat sensitive head overwrites different overwrite image data B1 (or B2) on the remaining initial image (initial image data) A to produce a superimpose image (superimpose image data) C1 (or C2), making the initial image A on the spent ink ribbon illegible, as shown in FIGS. 1A to 1E.

More concretely, FIG. 1A illustrates one example of the initial image A, FIG. 1B one example of the overwrite image data B1 having a random character row, and FIG. 1C illustrates one example of the superimpose image C1 obtained by superimposing the image data B1 on the initial image A.

As obvious from FIG. 1C, it is almost impossible to make out the initial image A in the superimpose image C1.

Then, the overwrite image data B1 is generated with use of random character rows including numerals, alphabets, kana, kanji, etc. on the ground of e.g. JIS (Japanese Industrial Standards). Further, as the overwrite image data B1 is overwritten upon turning over the ink ribbon, the resulting superimpose image C1 comprises the initial image A and the upside-down overwrite image data B1 on the ink ribbon, as shown in FIG. 1C. Thus, it is almost impossible to make out the initial image A in the superimpose image C1.

Besides the random character rows, the above publication discloses the generating of overwrite image data B2 with use of relatively simple graphic symbols, such as kinked line and broken line (not shown), as shown in FIG. 1D. FIG. 1E illustrates a superimpose image C2 where the overwrite image data B2 is overlaid on the initial image A. In connection, the publication has a statement that it is almost impossible to make out the initial image A in the superimpose image C2.

SUMMARY OF THE INVENTION

In the above-mentioned transfer type image recorder of the publication, however, the overwrite image data B1 (or B2) has to be recorded on the spent ink ribbon after replacing a supply reel and a take-up reel for ink ribbon with each other. Therefore, the replacing operation of these reels is complicated for an operator.

There is a case that the initial image is formed by a combination of large and small characters in different heights although it is not shown. In the above publication, there is no description about overwrite image data for the initial image consisting of characters in different heights.

In the above publication, additionally, there is no description about a situation of transferring the superimpose image C1 (or C2), which has been produced by superimposing the overwrite image data B1 (or B2) on the initial image A on the ink ribbon, to an intermediate transfer film as a sort of transferred object.

Under such a circumstance, an object of the present invention is to provide thermal transfer printing method and apparatus capable of making both an initial character image on the ink ribbon and a superimpose character image, which has been transferred to either an intermediate transfer film (as a sort of transferred object) or a new transferred object different from the printed object illegible more certainly.

In order to achieve the above object, according to the present invention, there is provided a thermal transfer printing method comprising the steps of opposing a first area in an ink ribbon having an ink layer to a second area in a first transferred object so that an end of the first area in a feeding direction of the ink ribbon is aligned with an end of the second area in the feeding direction, applying first image data having either characters or graphics on a thermal head while feeding the ink ribbon and the first transferred object to transfer the ink layer in the first area to the second area of the first transferred object thereby forming a first image based on the first image data in the second area, opposing the ink ribbon to the first transferred object so that the end of the first area in the feeding direction is aligned with the end of the second area in the feeding direction, applying second image data having either characters or graphics on the thermal head while feeding the ink ribbon and the first transferred object to transfer the ink layer in the first area to the second area of the first transferred object thereby forming a second image based on the second image data in the second area, opposing the ink ribbon to the first transferred object so that the end of the first area in the feeding direction is shifted from the end of the second area in the feeding direction by a predetermined distance and applying third image data having either characters or graphics for overwriting, the third image data being identical to or different from the second image data, on the thermal head while feeding the ink ribbon and the first transferred object to transfer the ink layer in the first area to the second area of the first transferred object thereby forming a third image based on the third image data in the second area.

Further, there is also provided a thermal transfer printing apparatus comprising an ink ribbon having an ink layer, a first transferred object, a first detecting unit for detecting the position of the ink layer in the ink ribbon to output a first detection signal, a second detecting unit for detecting a feeding position of the first transferred object to output a second detection signal, a first feeding unit for feeding the ink ribbon based on the first signal, a second feeding unit for feeding the first transferred object based on the second signal, a transfer unit for pressing the ink ribbon to the first transferred object and heating the ink layer to form a transferred image on the first transferred object, a first image-data generating unit for generating first image data having either characters or graphics and outputting the first image data to the transfer unit, a second image-data generating unit for generating second image data having either characters or graphics for overwriting and outputting the second image data to the transfer unit and a controller for controlling the first feeding unit, the second feeding unit and the transfer unit, wherein the controller controls the first feeding unit and the second feeding unit so that the ink ribbon and the first transferred object are laid to overlap each other in a manner that an end of a first area of the ink ribbon in a feeding direction thereof is aligned with an end of a second area of the first transferred object in the feeding direction, and also controls the transfer unit so that ink of the ink layer in the first area is transferred to the second area to form a first image based on the first image data in the second area, the controller controls the first feeding unit and the second feeding unit so that the ink ribbon and the first transferred object are laid to overlap each other in a manner that the end of the first area in the feeding direction is aligned with the end of the second area in the feeding direction, and also controls the transfer unit so that the ink of the ink layer in the first area is transferred to the second area to form a second image based on the second image data in the second area, and the controller controls the first feeding unit and the second feeding unit so that the ink ribbon and the first transferred object are laid to overlap each other in a manner that the end of the first area in the feeding direction is shifted from the end of the second area in the feeding direction by a predetermined distance, and also controls the transfer unit so that the ink of the ink layer in the first area is transferred to a third area including the second area to form the second image based on the second image data in the third area.

BRIEF DESCRIPTION OF THE DRAWINGS

FIGS. 1A to 1E are views showing initial image data, overwrite image data and superimpose image data respectively to explain an operation of making the initial image data remaining on an ink ribbon after use, illegible with use of a conventional transfer image recorder;

FIGS. 28A, 28B and 28C are views showing the overwrite image data generated by the overwrite image-data generating unit of the third embodiment, in which FIG. 28A shows a horizontal stripe pattern, FIG. 28B shows an oblique stripe pattern and FIG. 28C shows a check pattern;

FIGS. 30A to 30D are second operational views explaining the operation of making both the initial character image printed on the ink ribbon and the superimpose character image transferred on the intermediate transfer film, illegible in the third embodiment.

DETAILED DESCRIPTION OF THE PREFERRED EMBODIMENTS

Embodiments of thermal transfer printing method and apparatus of the present invention will be described below, with reference to FIGS. 2 to 31D.

Figure 2:
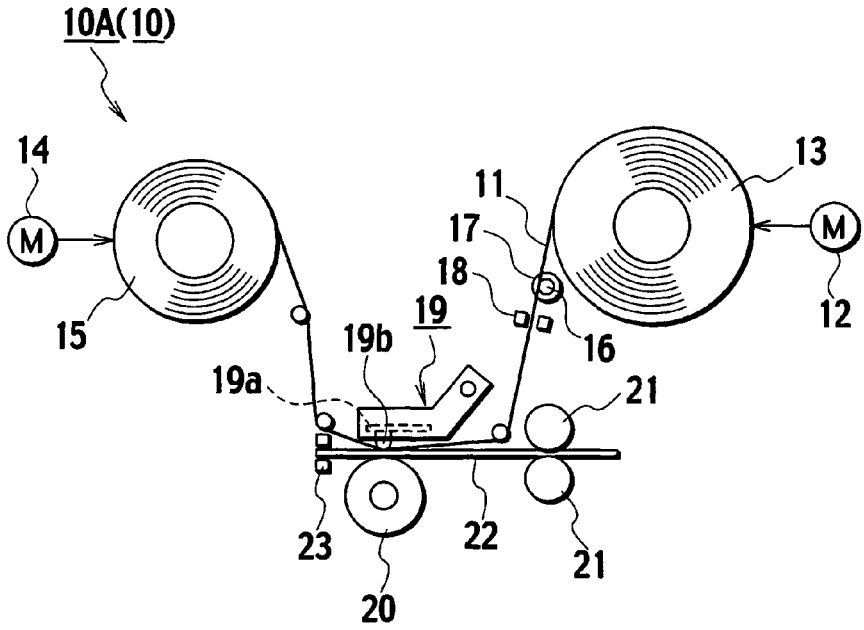
FIG. 2 is a structural view showing a thermal transfer printing apparatus embodying thermal transfer printing method and apparatus of the present invention.
Figure 4:
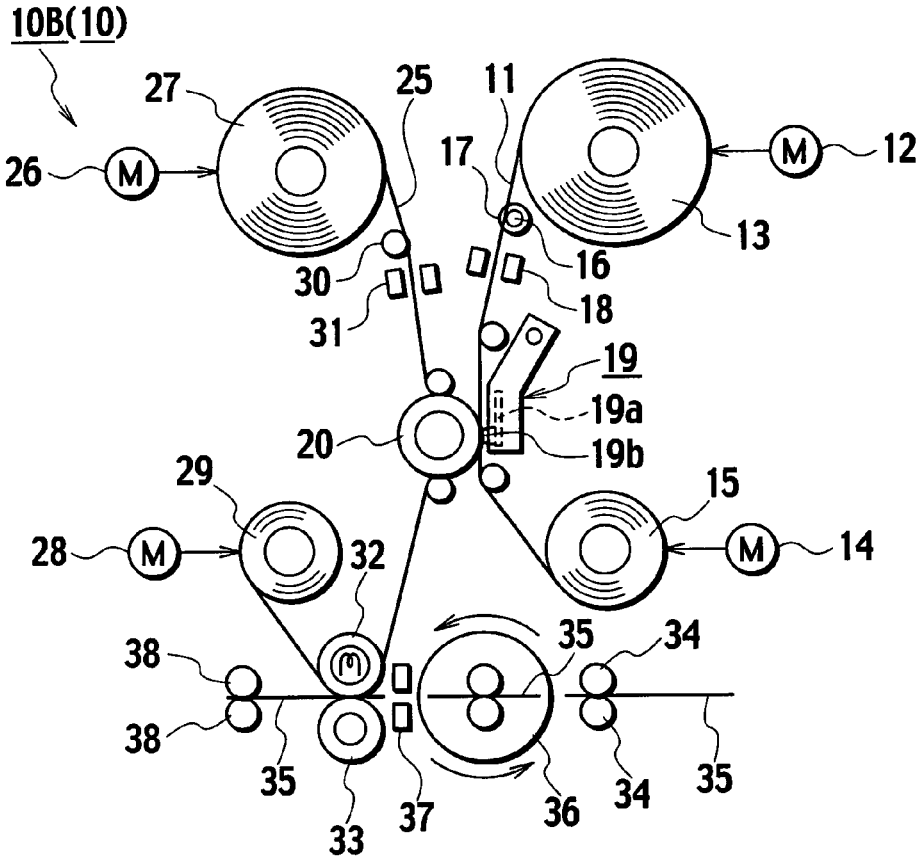
FIG. 4 is a structural view of a thermal transfer printing apparatus embodying thermal transfer printing method and apparatus of the present invention.

In these figures, FIG. 2 shows a thermal transfer printing apparatus 10A in which image data (image information, character information, etc.) is directly printed on a recording paper 22 by a thermal head 19 while transferring an ink ribbon 11 and the recording paper 22 in piles. FIG. 4 shows a thermal transfer printing apparatus 10B in which image data is transfer-printed from the thermal head 19 to an intermediate transfer film 25 while feeding the ink ribbon 11 and the intermediate transfer film 25 in piles and subsequently, the print image on the intermediate transfer film 25 is re-transferred on a card 35. The thermal transfer printing method and apparatus of the present invention are applicable to both of these printing apparatuses 10A, 10B.

In common with three later-mentioned embodiments, the thermal transfer printing method (or apparatus) is characterized in that when transferring print image data from the thermal head 19 to the recording paper 22 (or the intermediate transfer film 25), especially, when a user judges that the print image data contains character information to be handled with high security, it is carried out by the thermal head 19 to overwrite different image data from the initial character image on the initial character image (i.e. initial character image data) remaining in the spent ink ribbon 11 in order to produce a superimpose character image (i.e. superimpose image data), making the initial character image illegible on the ink ribbon. Additionally, even if a superimpose character image obtained by combining the initial character image and the overwrite image data in piles is transferred to the intermediate transfer film (a sort of transferred object) or a new transferred object different from the printed transferred object, it is possible to make the superimpose character image illegible on such a transferred object certainly.

Figure 3A:
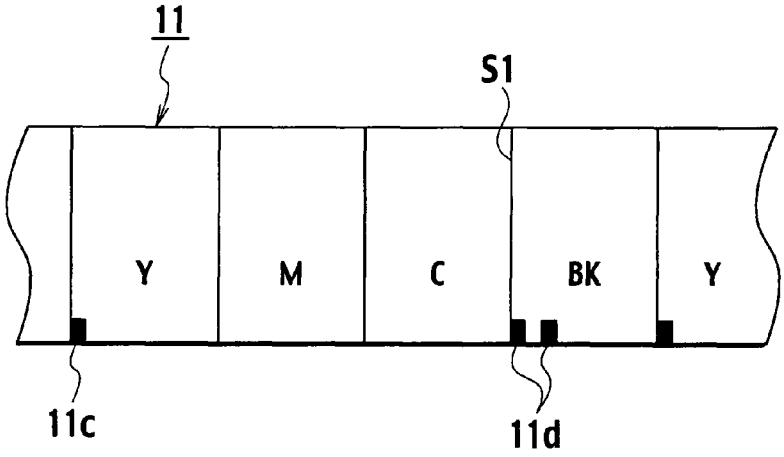
FIG. 3A is a plan view to explain an ink ribbon shown in FIG. 2.
Figure 3B:
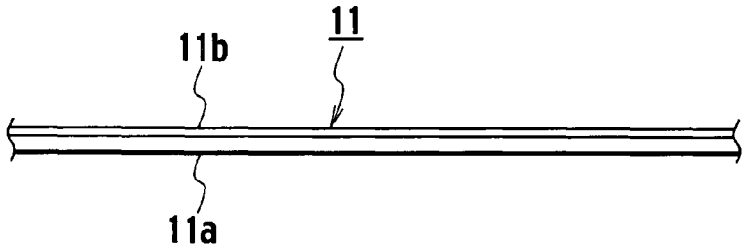
FIG. 3B is a side view of the ink ribbon.

In the thermal transfer printing apparatus 10A, the ink ribbon 11 is wound around a supply reel 13 connected to a DC motor 12 and a take-up reel 15 connected to a DC motor 14. Between the supply reel 13 and the take-up reel 15, the ink ribbon 11 is guided by a plurality of guide rollers 16. As shown in FIGS. 3A and 3B, the ink ribbon 11 has a strip-shaped ribbon base 11*a* and a sublimation (or fusible) multi-colored ink layer 11*b* applied on the ribbon base 11*a*. The ink layer 11*b* consists of respective inks layers in yellow (Y), magenta (M), cyan (C) and black (BK) applied on the ribbon base 11*a* repeatedly and periodically. As shown in FIG. 3A, the ink layer 11*b* in respective colors is compartmentalized into a plurality of segments each having a predetermined size in accordance with the size of the recording paper 22 as a sort of transferred object. Near an outlet of the supply reel 13, the guide roller 16 is integrally connected to a pulse generator 17 generating pulses corresponding to the rotation of the guide roller 16 caused by the transfer of the ink ribbon 11. With an operation of counting the number of pulses generated, the pulse generator 17 is used to shift a forefront position S1 (see FIG. 3A) of the ink layer 11*b* (in BK) of the ink ribbon 11 by a predetermined length backward or forward in the feeding direction of the ribbon 11 subsequently to a cueing of the forefront position S1.

A first sensor 18 is arranged on the downstream side of the guide roller 16 close to the outlet of the supply reel 13 to detect a cueing mark 11*c* of each yellow (Y) segment and cueing marks 11*d* of each black (BK) segment in respective groups.

Between the supply reel 13 and the take-up reel 15, a thermal head 19 is arranged on the side of the ribbon base 11*a* of the ink ribbon 11 so as to oppose a rotatable platen roller 20. The thermal head 19 has a plurality of heating resistive elements 19*b* arranged on a printed wiring substrate 19*a* at predetermined pitches in a main scan direction. Further, the thermal head 19 is adapted so as to be separable from the platen roller 20.

A pair of paper feeder roller 21, 21 are arranged to feed the recording paper 22 in between the ink ribbon 11*a* butting on the heating resistive elements 19*b* and the platen roller 20. On the downstream side of the platen roller 20, a second sensor 23 is arranged to detect a forefront position of the recording paper 22.

The main scan direction to arrange the heating resistive elements 19*b* in the thermal head 19 is identical to a direction to allow the elements 19*b* to scan print image data (image information, character information, etc.) along lines in the recording paper 22. While, a feeding direction (sub-scan direction) of the recording paper 22 is perpendicular to the main scan direction.

In performing a normal transfer operation (printing operation) with the drive of the thermal transfer printing apparatus 10A constructed above, the ink ribbon 11 and the recording paper 22 are laid between the heating resistive elements 19*b* of the thermal head 19 and the rotatable platen roller 20 so as to overlap each other. While feeding the ribbon 11 and the paper 22 in piles due to the driving force of the platen roller 20, the multicolored ink layer is transferred onto the recording paper 22 with respect to each color repeatedly, corresponding to image signals of respective colors.

Next, the thermal transfer printing apparatus 10B of FIG. 4 on application of the thermal transfer printing method and apparatus of the invention will be described below. The thermal transfer printing apparatus 10B is different from the above-mentioned printing apparatus 10A in that the recording paper printed by the thermal head 19 is replace by the intermediate transfer film 25 and additionally, a card 35 is employed as the recording paper.

Also in the thermal transfer printing apparatus 10B, the ink ribbon 11 is wound around the supply reel 13 connected to the DC motor 12 and the take-up reel 15 connected to the DC motor 14. Between the supply reel 13 and the take-up reel 15, the ink ribbon 11 is guided by the plural guide rollers 16. As shown in FIGS. 3A and 3B, the ink ribbon 11 includes the sublimation (or fusible) multicolored ink layer 11*b* in which a group of yellow, magenta, cyan and black layers are formed on the ribbon base 11*a* repeatedly and periodically. The ink layer 11*b* in respective colors is compartmentalized into a plurality of segments each having a predetermined size in accordance with a color image frame of the intermediate transfer film 25 (i.e. a sort of transferred object) and the card 35.

Similarly to the printing apparatus 10A, the guide roller 16 is integrally connected to the pulse generator 17 near the outlet of the supply reel 13. The pulse generator 17 generates pulses corresponding to the rotation of the guide roller 16 caused by the transfer of the ink ribbon 11. With the operation of counting the number of pulses generated, the pulse generator 17 is used to shift the forefront position S1 (see FIG. 3A) of the ink layer 11*b* (in BK) of the ink ribbon 11 by a predetermined length backward or forward in the feeding direction subsequently to the cueing of the forefront position S1.

The first sensor 18 is arranged on the downstream side of the guide roller 16 close to the outlet of the supply reel 13 to detect the cueing mark 11*c* of each yellow (Y) segment and the cueing marks 11*d* of each black (BK) segment in respective groups.

Between the supply reel 13 and the take-up reel 15, the thermal head 19 is arranged on the side of the ribbon base 11*a* of the ink ribbon 11 so as to oppose the rotatable platen roller 20. The thermal head 19 has the heating resistive elements 19*b* arranged on the printed wiring substrate 19*a* at predetermined pitches in the main scan direction. Further, the thermal head 19 is adapted so as to be separable from the platen roller 20.

Figure 5A:
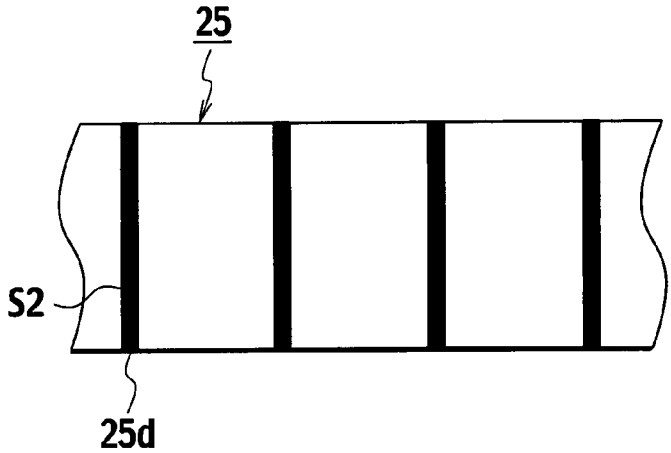
FIG. 5A is a plan view to explain an intermediate transfer film shown in FIG. 4.
Figure 5B:
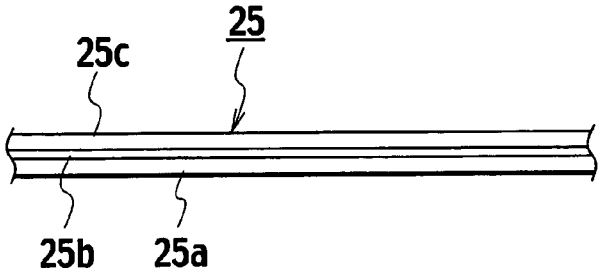
FIG. 5B is a side view of the intermediate transfer film.

As shown in FIGS. 5A and 5B, the intermediate transfer film 25 has a strip-shaped film base 25*a*, an exfoliative layer 25*b* and a transparent image reception layer 25*c* laminated on each other in this order. The intermediate transfer film 25 is wound around a supply reel 27 connected to a pulse motor 26 and a take-up reel 29 connected to a DC motor 28 through a plurality of guide rollers 30 and a part of the platen roller 20. A second sensor 31 is arranged on the downstream side of the guide roller 30 close to the outlet of the supply reel 27 to detect each cueing mark 25*d* of respective color image frames of the intermediate transfer film 25.

In the transfer route of the intermediate transfer film 25, a heat roller 32 and a pressure roller 33 are rotatably arranged so as to oppose each other on the downstream side of the platen roller 20.

In operation, an unprinted card 35 is fed to a card reversing part 36 by a pair of card feed rollers 34, 34. Then, after passing through a third sensor 37 for card cueing, the card 35 is fed in between the beat roller 32 and the pressure roller 33. Subsequently, the printed card 35 is discharged to outside by a pair of card feed rollers 38, 38.

In order to re-transfer the printed image printed on the intermediate transfer film 25 to both sides of the card 35 easily, the card reversing part 36 is provided to turn over the card 35 after the printed image has been transferred to one side of the card 35.

In performing a normal re-transfer operation with the drive of the thermal transfer printing apparatus 10B constructed above, the ink ribbon 11 and the intermediate transfer film 25 are overlapped on each other between the heating resistive elements 19*b* of the thermal head 19 and the rotatable platen roller 20. While transferring the ribbon 11 and the paper 22 in piles due to the driving force of the platen roller 20, the multicolored ink layer is repeatedly transferred onto the transparent image reception layer 25*c* of the film 25 with respect to each color by heat from the heating resistive elements 19*b* activated corresponding to image signals of respective colors, forming one frame of color image.

After that, the color image (one frame) transferred onto the transparent image reception layer 25*c* of the film 25 is re-transferred onto the card 35, which has been fed in between the heat roller 32 and the pressure roller 33, under heat and pressure upon peeling the transparent image reception layer 25*c* off the exfoliative layer 25*b*.

Figure 6:
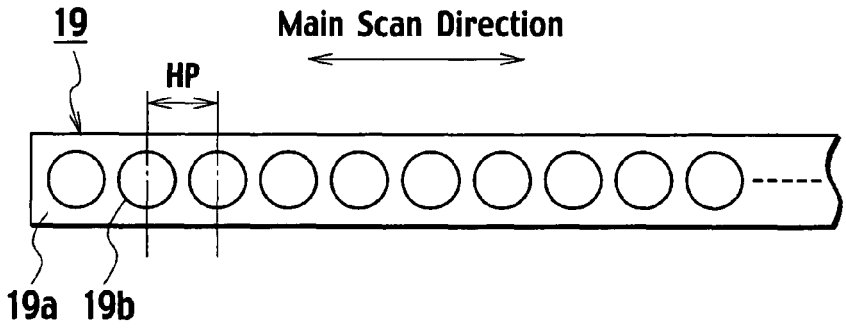
FIG. 6 is an enlarged view of a thermal head shown in FIGS. 2 and 4.

The thermal head 19 in common with the thermal transfer printing apparatuses 10A, 10B has a plurality of heating resistive elements 19*b* arranged on the printed wiring substrate 19*a* at predetermined pitches in the main scan direction, as shown in FIG. 6 in enlargement. Further, the thermal head 19 is formed so that the heating resistive elements 19*b* are driven corresponding to the print image data selectively.

Figure 7:
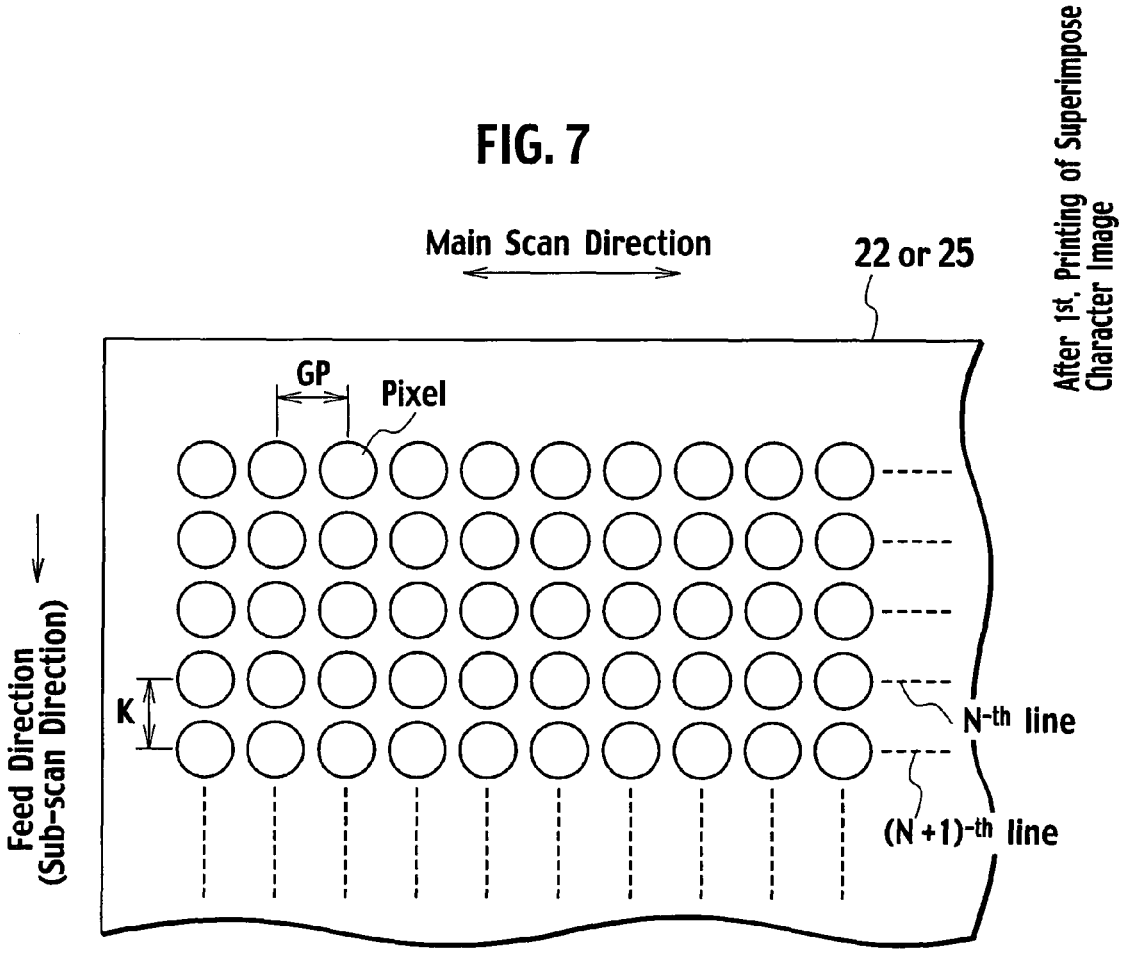
FIG. 7 is a view typically showing a situation where image data is printed (with transferred ink layers) on a recording paper (or an intermediate transfer film) by a thermal head having a plurality of heating resistive elements aligned at predetermined pitches in a main scan direction while transferring both a strip-shaped ink ribbon having multicolor ink layers and the recording paper (or the intermediate transfer film) in piles.

Thus, when printing the print image data (image information, character information, etc.) on the recording paper 22 (or the intermediate transfer film 25) through the thermal head 19 while overlapping the ink ribbon 11 (see FIGS. 2 and 4) and the recording paper 22 (or the intermediate transfer film 25) on each other, the paper 22 (or the film 25) has a printed image characterized by a pitch GP between the pixels adjoining along the main scan direction, the pitch GP being equal to a pitch HP between the adjoining heating resistive elements 19*b* of the thermal head 19, as shown in FIG. 7.

On the other hand, a distance K between the pixels adjoining along the feeding direction (sub-scan direction) of the recording paper 22 (or the intermediate transfer film 25) is determined by its transfer speed corresponding to a printing time required for printing one line on the paper 22 (or the film 25).

Next, an electrical constitution of the thermal transfer printing method and apparatus of the invention will be described with reference to FIGS. 8 and 9.

After printing a normal print image data on the recording paper 22 (or the intermediate transfer film 25) through the thermal head 19 upon overlapping the ink ribbon 11 (FIGS. 2 and 4) and the paper 22 (or the film 25) on each other, if a user finds out the normal print image data contains important character information to be handled with high security, it is performed in accordance with the thermal transfer printing method and apparatus of the invention to adopt either one signal transmission form (see FIG. 8) that an exterior personal computer (PC) 40 generates overwrite character image data to be overwritten on an initial character image with high security remaining in the ink ribbon 11 or another signal transmission form (see FIG. 9) that the thermal transfer printing apparatus 10 (10A or 10B) generates the above overwrite character image automatically.

Figure 8:
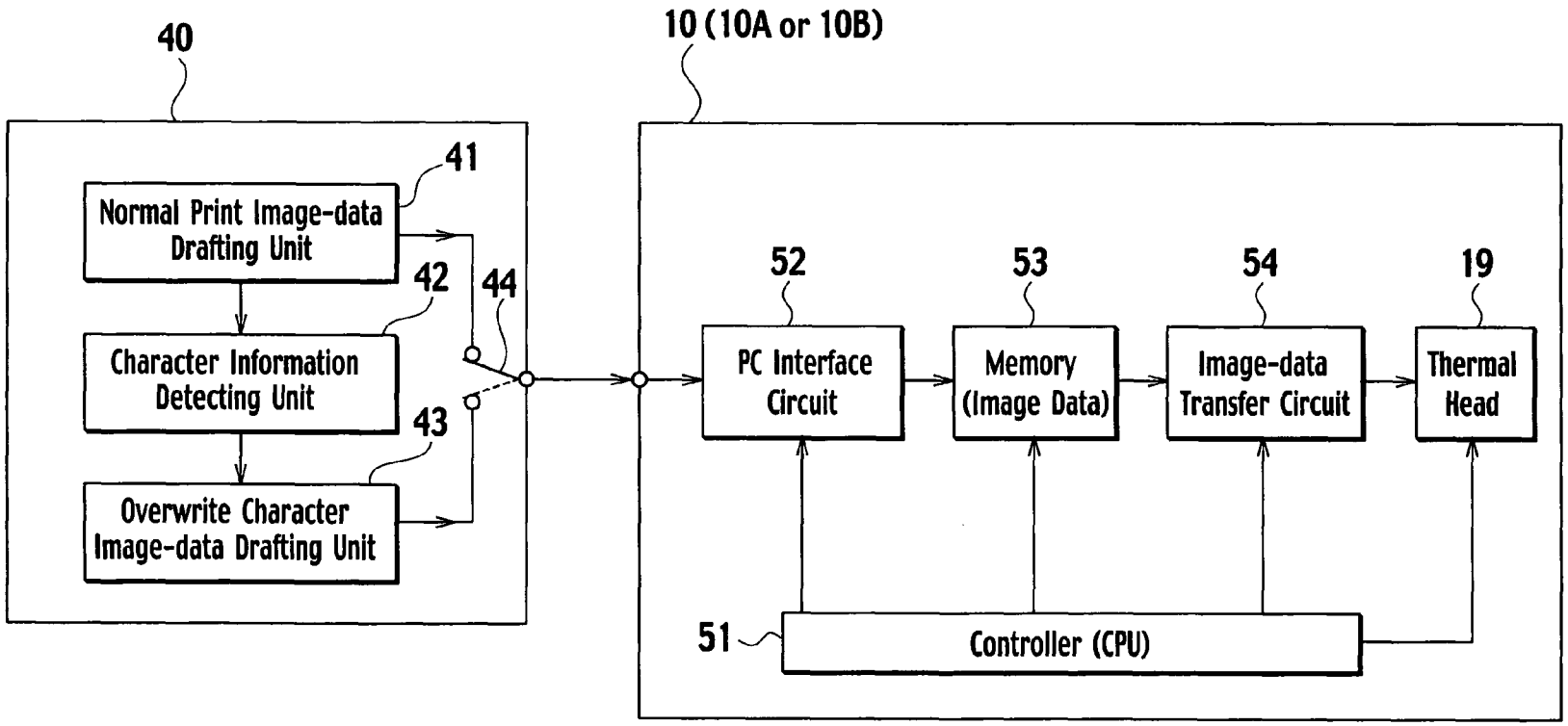
FIG. 8 is a block diagram showing a form to transmit normal image data or overwrite character image data generated in an exterior personal computer (PC) to the thermal transfer printing apparatus and subsequently apply the data on the thermal head in the thermal transfer printing apparatus of the present invention.

In the former signal transmission form of FIG. 8, the exterior personal computer 40 includes a normal print image-data generating unit 41 for generating and generating first overwrite character-frame image data, a character information detecting unit 42 that detects and outputs character information in e.g. black (BK) when normal print image data generated by the unit 41 contains this character information, an overwrite character image-data generating unit 43 for generating overwrite character image data to be overwritten on the initial character image data corresponding to the character information detected by the unit 42 and a switching unit 44 for selecting either the normal print image data outputted from the unit 41 or the overwrite character image data outputted from the unit 43.

While, the thermal transfer printing apparatus 10 (10A or 10B) comprises a controller (CPU) 51 for controlling the whole constituents accomplishing the printing operation of the apparatus 10, a PC interface circuit 52 for downloading the normal print image data or the overwrite character image data selectively outputted from the personal computer 40, by an electrical communication tool such as USB or LAN, a memory 53 for storing the normal print image data or the overwrite character image data (forming one screen) downloaded to the PC interface circuit 52 temporarily and an image-data transfer circuit 54 for transferring the stored image data to the thermal head 19.

Figure 9:
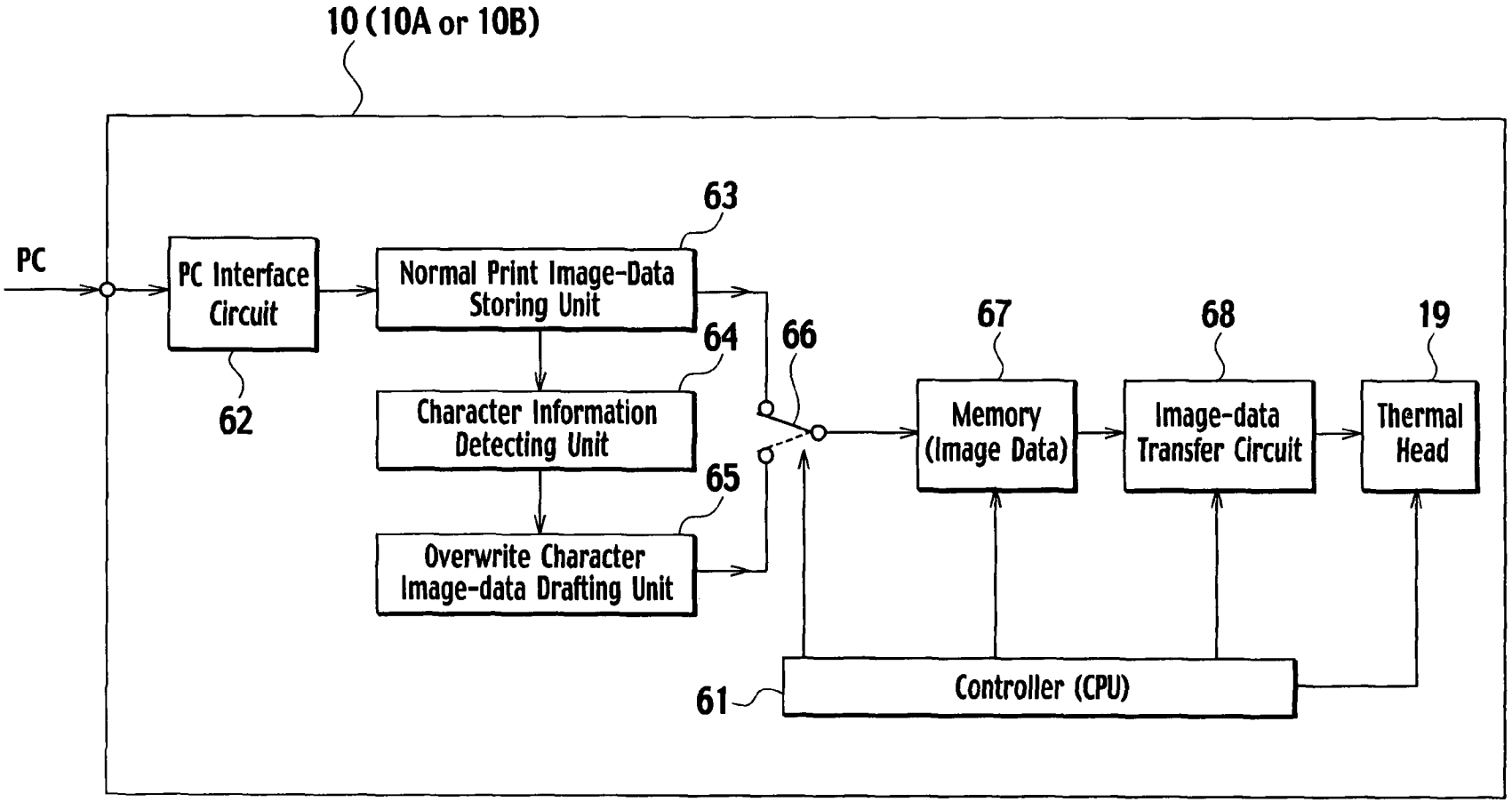
FIG. 9 is a block diagram showing a form to generate overwrite character image data in the thermal transfer printing apparatus of the present invention while transmitting normal image data generated in the exterior personal computer (PC) to the thermal transfer printing apparatus and subsequently apply the normal image data or the overwrite character image data on the thermal head.

In the signal transmission form shown in FIG. 9, the thermal transfer printing apparatus 10 (10A, 10B) comprises a controller (CPU) 61 for controlling the whole constituents accomplishing the printing operation of the apparatus 10, a PC interface circuit 62 for downloading the normal print image data or the overwrite character image data generated in the personal computer 40, by an electrical communication tool such as USB or LAN, a normal print image-data storing unit 63 for storing the normal print image data via the PC interface circuit 62, a character information detecting unit 64 that detects and outputs character information in e.g. black (BK) when normal print image data stored in the unit 63 contains this character information, an overwrite character image-data generating unit 65 for generating overwrite character image data to be overwritten on the initial character image data corresponding to the character information detected by the unit 64, a switching unit 66 for selecting either the normal print image data outputted from the unit 63 or the overwrite character image data outputted from the unit 65, a memory 67 for storing the normal print image data or the overwrite character image data (forming one screen) selected by the unit 66 temporarily and an image-data transfer circuit 68 for transferring the normal print image data or the overwrite character image data stored in the memory 67 to the thermal head 19.

If an initial character image resulting from an apply of important initial character image data to be handled with high security on the thermal head 19 is left on the ink layer in black (BK) of the ink ribbon 11 after use, the thermal head 19 overwrites "overwrite character image data" different from the initial character image data on the initial character image in order to make the initial character image on the ribbon 11 illegible. Then, if adopting the thermal transfer printing apparatus 10A of FIG. 2, it has only to feed a new recording paper 22 different from the printed recording paper 22 in between the thermal head 19 and the platen roller 20. We now describe three cases of overwriting overwrite character image data generated by the overwrite character image-data generating unit of the first embodiment or the second embodiment or overwrite image data generated by the overwrite image-data generating unit of the third embodiment on the initial character image on the ink ribbon 11 remaining as a result of transferring the initial character image to the ink ribbon 11 and the intermediate transfer film 25 by the thermal transfer printing apparatus 10B of FIG. 4.

As for the overwrite image data to make the initial character image data illegible on the ink ribbon, the overwrite character image data generated with character data is adopted in the first and second embodiments, while the overwrite image data where binary information of "0" and "1" is arranged in a predetermined pattern is adopted in the third embodiment. Nevertheless, the overwrite image data may be formed by any of characters, marks, patterns and so on.

1st Embodiment

The first embodiment of the invention will be described with reference to FIGS. 10 to 19C.

Figure 10:
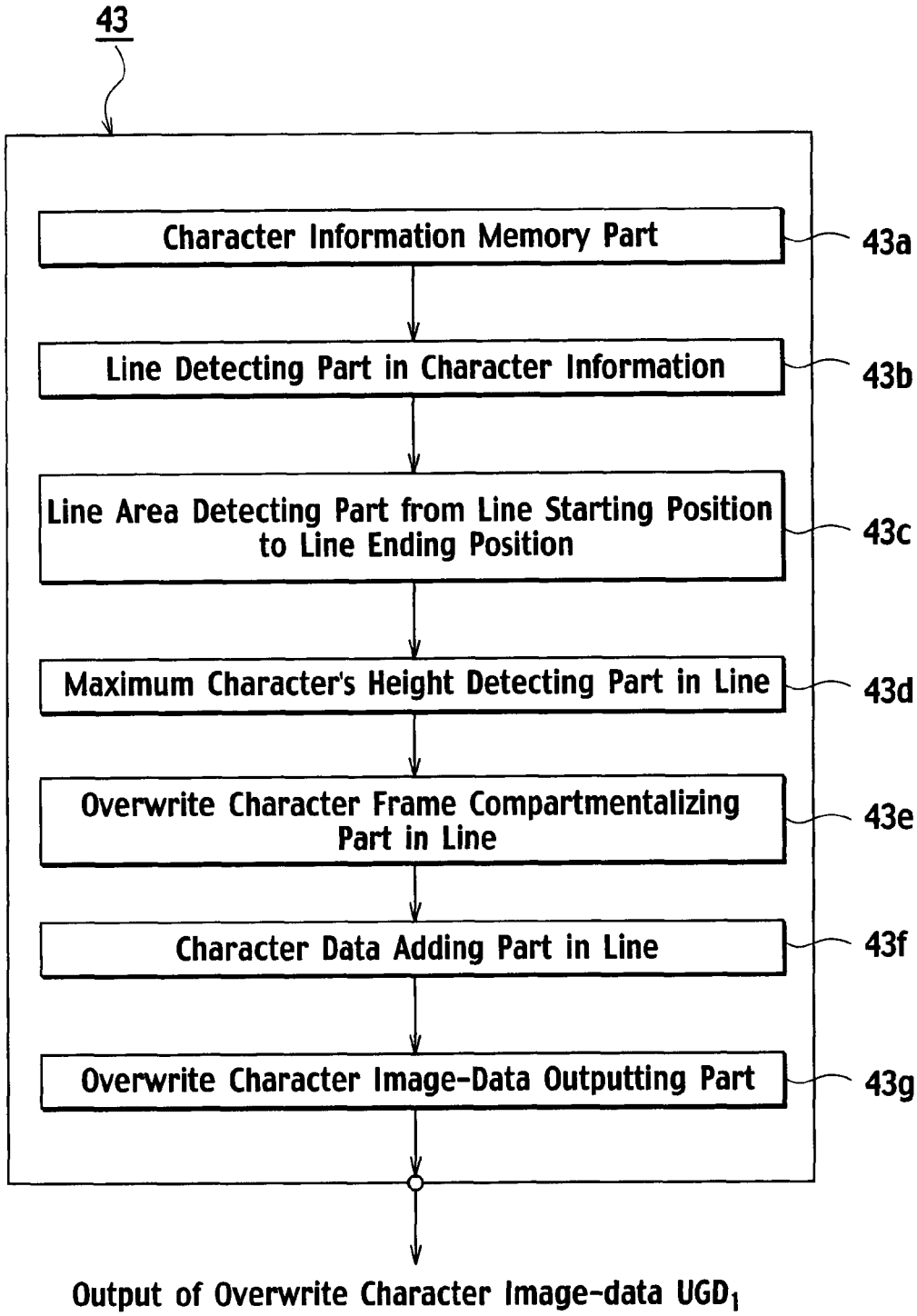
FIG. 10 is a view explaining an overwrite character image-data generating unit in accordance with a first embodiment of the present invention.

As shown in FIG. 8, the overwrite character image-data generating unit 43 of the first embodiment is arranged in the personal computer 40. FIG. 10 shows the constitution of the overwrite character image-data generating unit 43. Besides, of course, the constitution of the unit 43 is also applicable to the overwrite character image-data generating unit 65 in the thermal transfer printing apparatus 10 shown in FIG. 9 (description eliminated).

The overwrite character image-data generating unit 43 is constructed so that, when printing "initial character image data" (corres. the first image data of the invention) on the ink layer 11*b* in black (BK) of the ink ribbon 11 to obtain the initial character image, the initial character image data is processed to generate the overwrite character image data for illegibility.

In detail, the overwrite character image-data generating unit 43 comprises a character information memory part 43*a* for memorizing character information contained in the print image data generated by the normal print image-data generating unit 41 (see FIG. 8), a line detecting part 43*b* for detecting a line in the character information memorized in the part 43*a*, a line area detecting part 43*c* for detecting a line area spreading from a line starting position to a line ending position, a maximum character's height detecting part 43*d* for detecting the height of a maximum (largest) one of characters printed in the line area, an overwrite character frame compartmentalizing part 43*e* for compartmentalizing the line area into a plurality of overwrite character frames corresponding to the height of the maximum character printed in the line area, a character data adding part 43*f* for producing "additional character data" (corres. the second image data of the invention) with respect to each of overwrite character frames and an overwrite character image-data outputting part 43*g* for outputting respective additional character data (as the overwrite character image data against the line area) produced by the character data adding part 43*f* to the thermal head 19. In the constituents of the above unit 43, we now complement the additional character data produced by the character data adding part 43*f*. That is, on condition of linking a foremost one of the overwrite character frames with the rearmost one in a loop, the additional character data to be overwritten on the initial character data in one overwrite character frame is obtained by mutually adding up respective character data (data items) in at least two overwrite character frames adjoining one overwrite character frame sequentially.

The above-mentioned operation of the overwrite character image-data generating unit 43 will be described below. If it is judged by a user that there is important character information to be handled with high security in the print image data, it is executed to store the character information in the character information memory part 43*a*, in the form of an initial character image data $FGD_1$ shown in FIG. 11.

Figure 11:
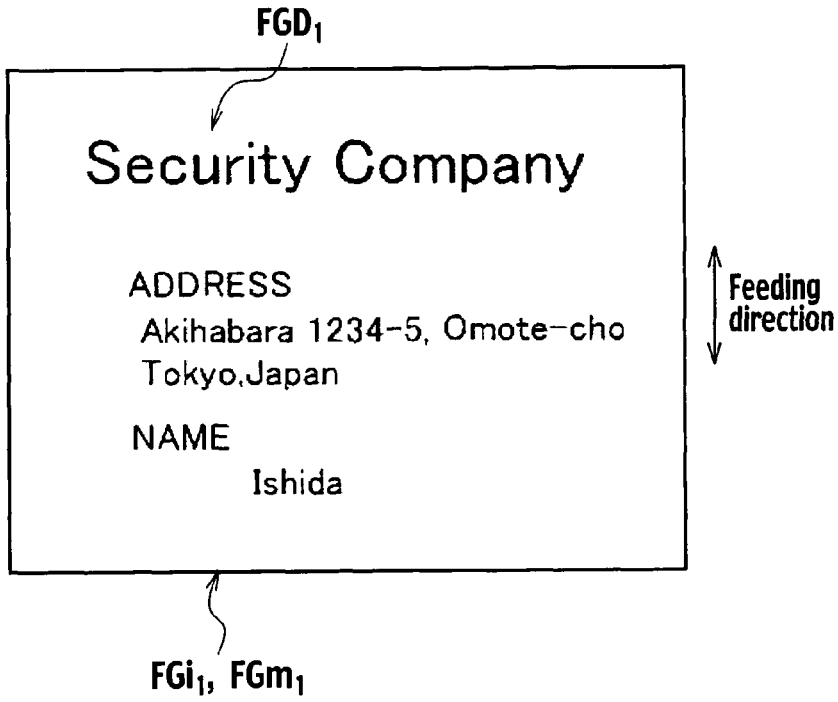
FIG. 11 is a view showing initial character image data in the overwrite character image-data generating unit of the first embodiment.

In FIG. 11, a feeding direction indicated with arrow designates a direction along which both the ink ribbon 11 (FIG. 3) and the intermediate transfer film 25 (FIG. 5) reciprocate in the thermal transfer printing apparatus 10 (10A, 10B). Throughout the following drawings, respective feeding directions indicated with arrows are identical to the above reciprocating direction.

Then, the initial character image data $FGD_1$ of the first embodiment is data which has been applied on the thermal head 19 and successively transferred from the ink layer 11*b* in black (BK) of the ink ribbon 11 (FIG. 3) to the intermediate transfer film 25. When the initial character image data $FGD_1$ is typed out onto the ink ribbon 11, the character information appears in the form of an initial character image $FGi_1$ (see FIG. 11) with outline characters in the ink layer 11*b* in black (BK). While, when the initial character image data $FGD_1$ is transferred onto the intermediate transfer film 25, the character information appears in the form of an initial character image $FGm_1$ with black characters as shown in FIG. 11.

Figure 12:
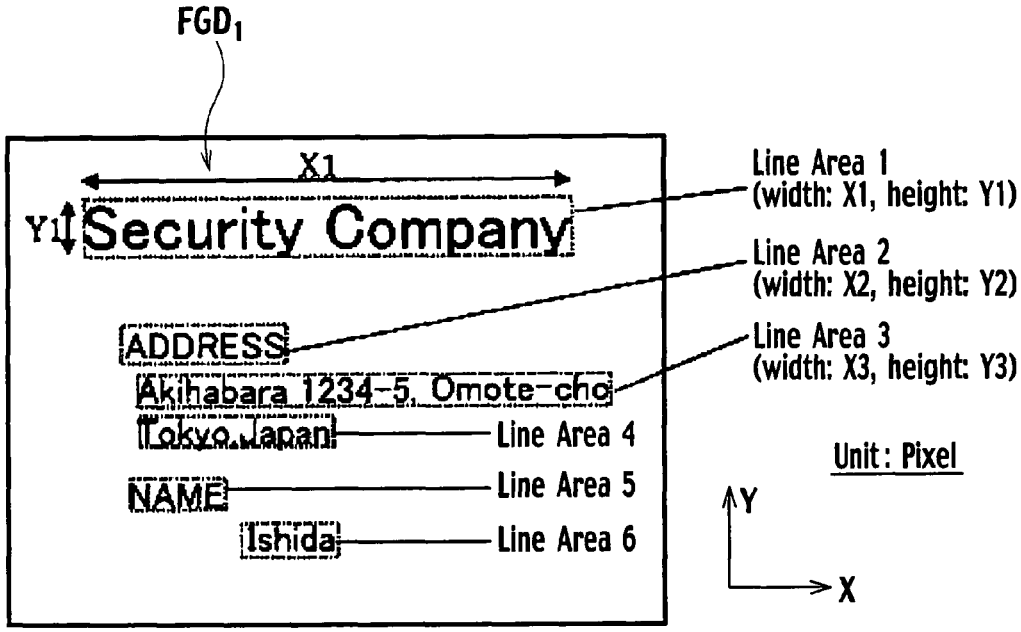
FIG. 12 is a view explaining character lines and line areas in the initial character image data in the overwrite character image-data generating unit of the first embodiment.

In the line detecting part 43*b*, it is executed to detect respective lines forming the initial character image data $FGD_1$ stored in the character information memory part 43*a*, as shown in FIG. 12. In this illustrated example, the same part 43*b* detects that the initial character image data $FGD_1$ includes six lines. After that, the line area detecting part 43*c* detects line area 1~line area 6 spreading from the line starting position to the line ending position and respective widths X1~X6 (X4, X5, X6: not shown) of these line areas 1~6 by the size and number of characters printed in the areas 1~6. Next, the maximum character's height detecting part 43*d* detects respective heights Y1~Y6 (Y4, Y5, Y6: not shown) of the largest (highest) characters in the line areas 1~6.

Figure 13:
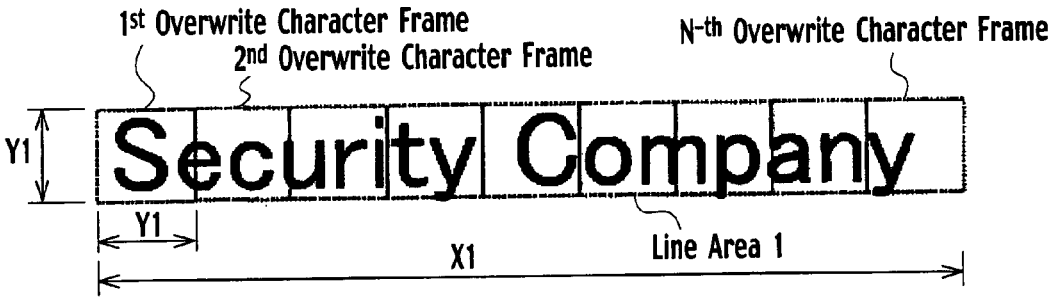
FIG. 13 is a view explaining an operation of comparting character boxes in a line of the initial character image data of FIG. 12.

For the line area 1 of FIG. 13 in enlargement, for instance, the overwrite character frame compartmentalizing part 43*e* compartmentalizing the line area 1 into a plurality of overwrite character frames by dividing the width X1 of the line area 1 by the maximum character's height Y1. In this way, there are obtained $1^{st}$ overwrite character frame, $2^{nd}$ overwrite character frame, . . . , and $N^{-th}$ overwrite character frame. This operation is also applied to the other line areas 2~6.

In the modification, the overwrite character frames may be compartmentalized in units of characters alternatively. In common with these compartmentalization, it means that the overwrite character frames are compartmentalized corresponding to the sizes of characters printed in the line areas.

Next, the character data adding part 43*f* generates overwrite character image data to be overwritten on the initial character image data. $FGD_1$ of FIG. 11. In order to obtain the above overwrite character image data to be overwritten, it is executed to form a loop of frames by linking a foremost one of the overwrite character frames (in each line) compartmentalized by the part 43*e* with the rearmost frame of the same line and further cumulate respective character data (data items) in at least two overwrite character frames adjoining a certain overwrite character frame. This operation is carried out with respect to each of the overwrite character frames forming each line.

Figure 14:
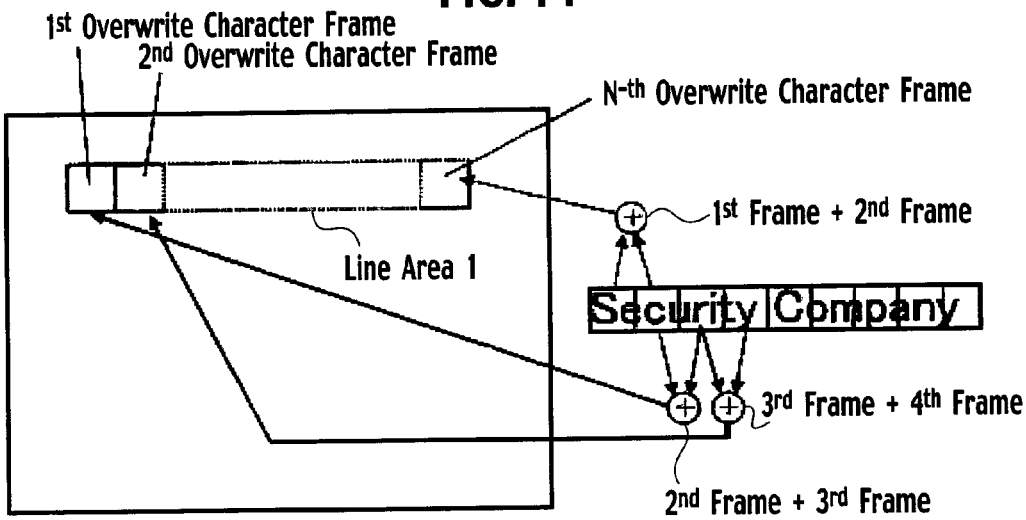
FIG. 14 is a view explaining an operation of adding up character data in generating the overwrite character data to be overwritten on character data in the line against the initial character image data of FIG. 12.

For instance, in the line area 1 of FIG. 14 in enlargement, a first overwrite character data to be overwritten on the $1^{st}$ overwrite character frame is identical to an adding character data that can be obtained by integrating both initial character data (data items) contained in the $2^{nd}$ and $3^{rd}$ overwrite character frames following the $1^{st}$ overwrite character frame in turn. Similarly, a second overwrite character data to be overwritten on the $2^{nd}$ overwrite character frame is identical to an adding character data that can be obtained by integrating both initial character data (data items) contained in the $3^{rd}$ and $4^{th}$ overwrite character frames following the $2^{nd}$ overwrite character frame in turn. Owing to the formation of a loop of frames, an $N^{-th}$ overwrite character data to be overwritten on the $N^{-th}$ overwrite character frame is identical to an adding character data that can be obtained by integrating both initial character data (data items) contained in the $1^{st}$ and $2^{nd}$ overwrite character frames following the $N^{-th}$ overwrite character frame in the loop.

Figure 15:
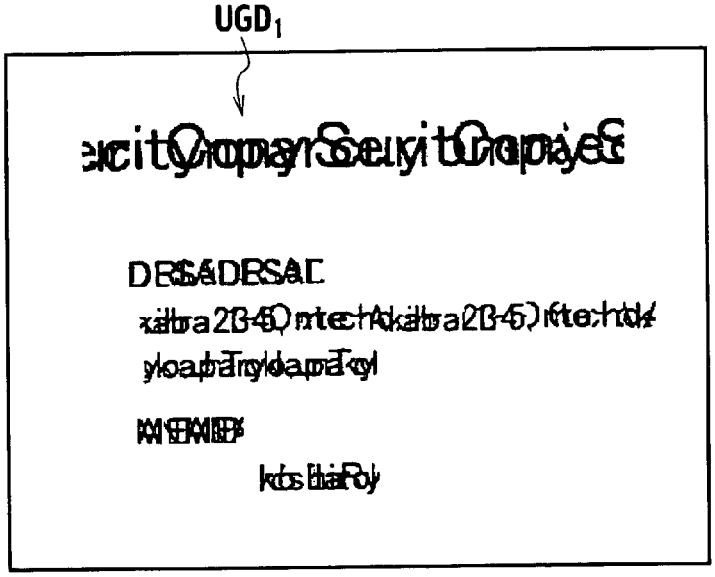
FIG. 15 is a view showing the overwrite character image data generated by the overwrite character image-data generating unit of the first embodiment.

Further, when the above character data adding operation is carried out to the line areas 2~6 similarly, there is obtained an overwrite character image data $UGD_1$ having a character image pattern different from that of the initial character image data $FGD_1$ (FIG. 12), as shown in FIG. 15. The resulting overwrite character image data $UGD_1$ is outputted from the overwrite character image-data outputting part 43*g* and successively applied on the thermal head 19.

Note, the above-mentioned method of adding up character data by the character data adding part 43*f* is illustrative only. Without being limited to this, it has only to integrate respective initial character data (data items) in a plurality of overwrite character frames that exclude an overwrite character frame to be overwritten in order to determine an overwrite character data on the objective character frame to be overwritten. It is preferable that this plurality of overwrite character frames include an overwrite character frame adjoining on at least one side of the overwrite character fame to be overwritten. Further, the number of data (items) to be integrated against the objective overwrite character frame may be three or more character data.

That is, according to the first embodiment, after processing the character image data of the line areas forming the initial character image data $FGD_1$ as original data and subsequently generating the overwrite character image data in units of line areas, it is applied on the thermal head 19.

The operation of the thermal transfer printing apparatus performing the operation of the first embodiment will be described with reference to FIG. 4 and FIGS. 16A to 17D.

Figures 16A, 16B, 16C:
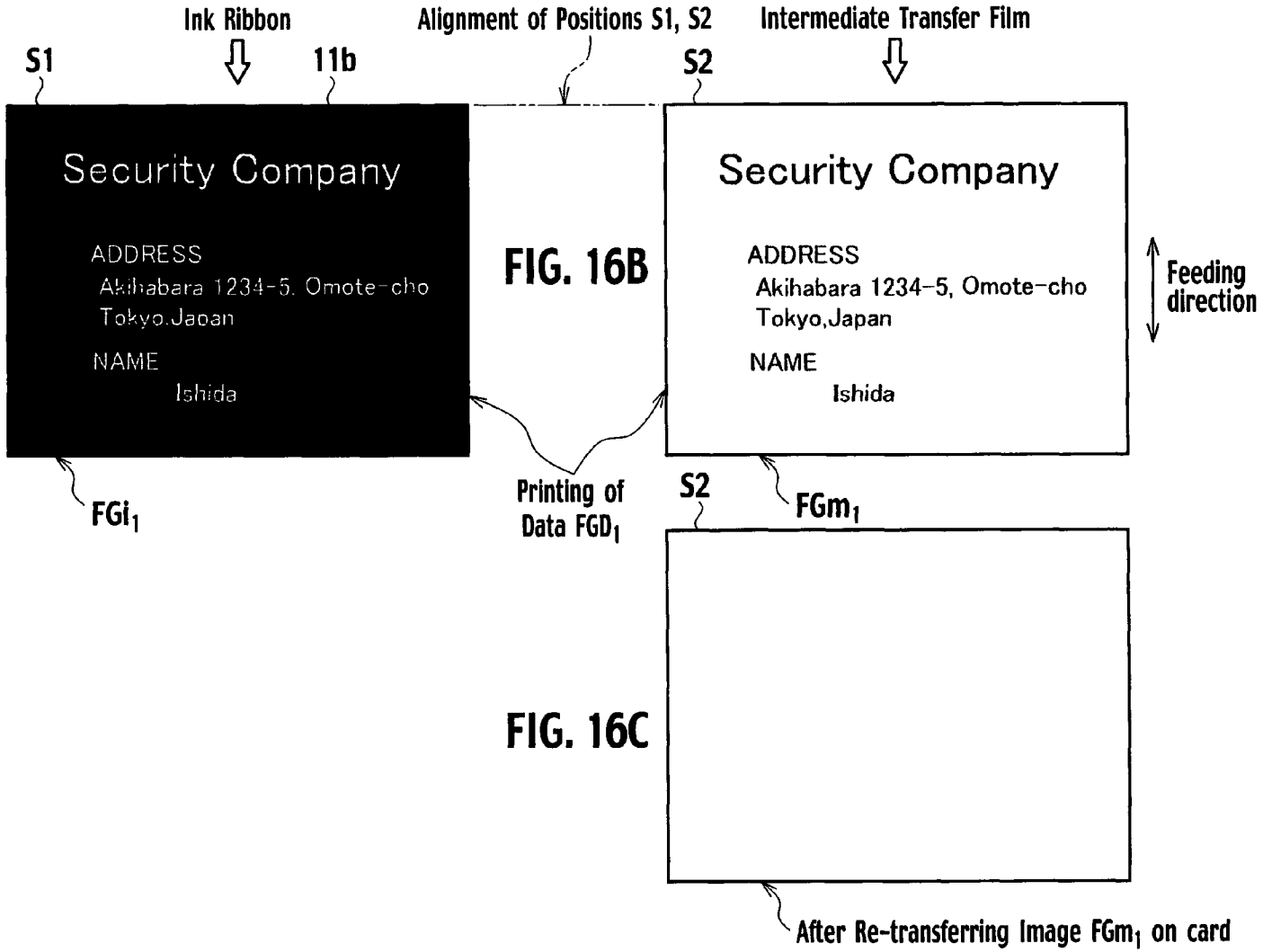
FIGS. 16A, 16B and 16C are first operational views explaining an operation of making both an initial character image printed on an ink ribbon and a superimpose character image transferred on an intermediate transfer film, illegible in the first embodiment.

First, as shown in FIGS. 4, 16A and 16B, with the drive of the controller 51 (FIG. 8), the first sensor 18 detects the cueing marks 11*d* (FIG. 3) in black (BK) of the unspent ink ribbon 11, while the second sensor 31 detects the cueing mark 25*d* (FIG. 5) in the color image frame of the unused intermediate transfer film 25. Upon detecting these cueing marks, the ink ribbon 11 and the intermediate transfer film 25 are fed so that the forefront position S1 of the ink ribbon 11 (i.e. one end of the ink layer 11*b* in BK in the feeding direction) is aligned with the forefront position S2 of the unused transfer film 25 (i.e. one end of the color image frame in the feeding direction) between the thermal head 19 and the platen roller 20.

After that, the initial character image data $FGD_1$ (FIG. 12) is applied on the thermal head 19 on condition of laying the ribbon 11 on the film 25. Consequently, there are obtained the initial character image $FGi_1$ on the ink layer 11*b* (BK) of the ink ribbon 11 and the initial character image $FGm_1$ on the intermediate transfer film 25.

As shown in FIG. 16C, when re-transferring the initial character image $FGm_1$ on the film 25 to the card 35, the image $FGm_1$ is removed from the film 25, so that the film base 25*a* (FIG. 3) only is exposed to outside.

Since the initial character image $FGi_1$ on the ink ribbon 11 has important character information to be handled with high security, it is necessary to make the same image $FGi_1$ illegible. On the contrary, it is unnecessary to make the initial character image $FGm_1$ transferred to the intermediate transfer film 25 illegible since the same image $FGm_1$ will be re-transferred onto the card 35.

Figures 17A, 17B, 17C, 17D:
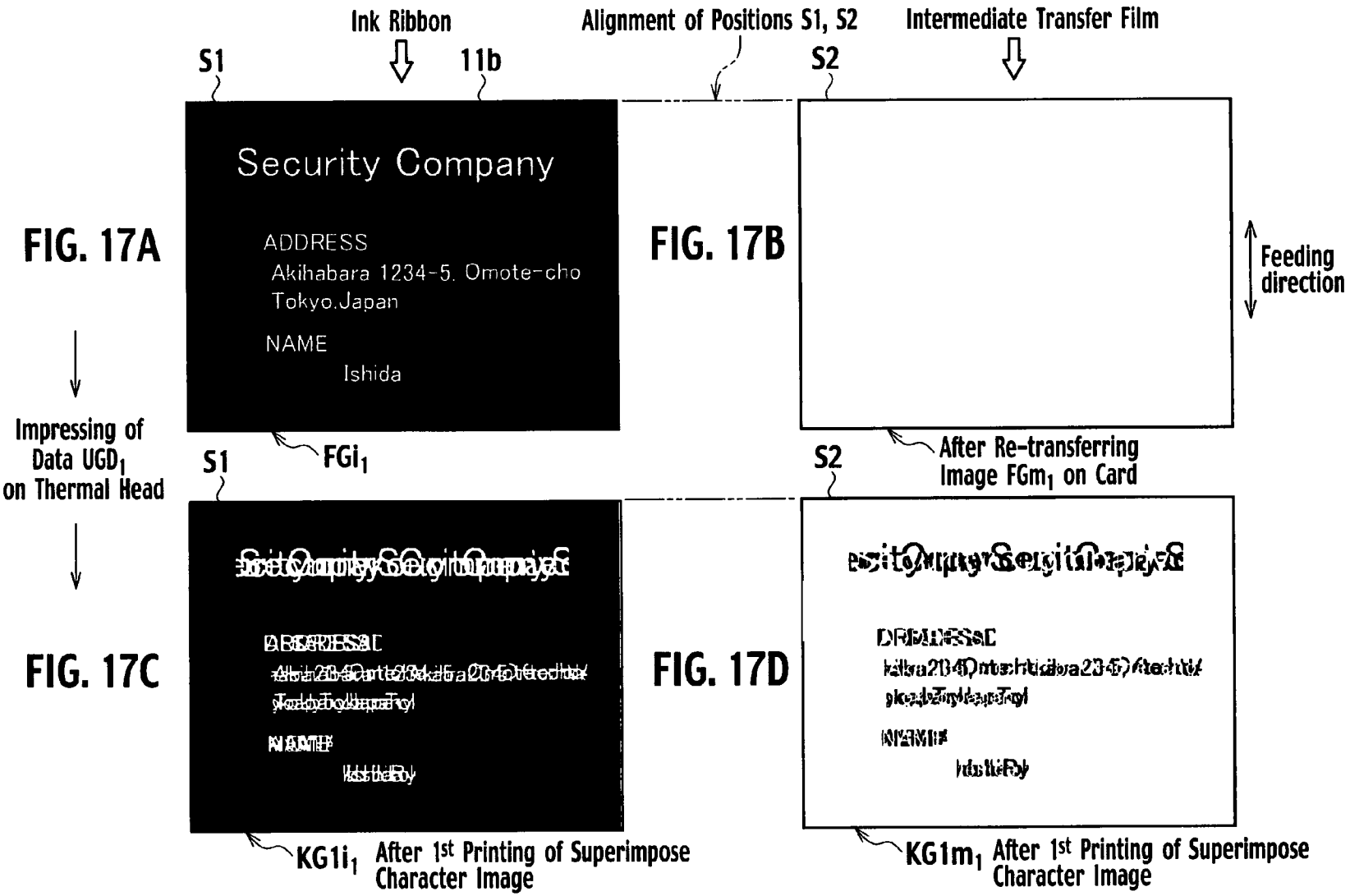
FIGS. 17A to 17D are second operational views explaining the operation of making both the initial character image printed on the ink ribbon and the superimpose character image transferred on the intermediate transfer film, illegible in the first embodiment.

Thus, after printing the initial character image $FGi_1$ onto the ink ribbon 11 and additionally re-transferring the initial character image $FGm_1$ on the intermediate transfer film 25 onto the card 35, the used ink ribbon 11 is rewound to the supply reel 13 to allow the first sensor 18 to detect the cueing marks 11*a* of the ribbon 11, while the used intermediate transfer film 25 is rewound to the supply reel 27 to allow the second sensor 31 to detect the cueing mark 25*d* of the color image frame on the used film 25, as shown in FIGS. 4, 17A and 17B. Then, on condition of aligning the forefront position S1 of the ink layer 11*b* (BK) of the used ink ribbon 11 with the forefront position S2 of the used intermediate transfer film 25, they (the ribbon 11, the film 25) are laid to overlap each other and further supplied in between the thermal head 19 and the platen roller 20.

After that, by the overwrite character image-data generating unit 43 (FIG. 10), two or more character data adjoining one initial character data in each line of the line areas 1~6 are cumulates to produce data to be overwritten on the above initial character data and further, this operation is repeated against all of plural initial character data (items) forming each line to produce the overwrite character image data $UGD_1$ having a character image pattern different from that of the initial character image data $FGD_1$ (FIG. 12), as shown in FIG. 15. Then, the so-generated overwrite character image data $UGD_1$ is applied on the thermal head 19 to overwrite the same data $UGD_1$ on the initial character image $FGi_1$ printed on the ink layer 11*b* (BK) of the ink ribbon 11. Consequently, there are obtained a first superimpose character image $KG1i_1$ on the ink ribbon 11 and a first superimpose character image $KG1m_1$ on the intermediate transfer film 25, as shown in FIGS. 17C and 17D.

By the way, when overwriting the overwrite character image data $UGD_1$ on the initial character image $FGi_1$ on the ink ribbon 11 in the thermal transfer printing apparatus 10A of FIG. 2, it has only to transfer the overwrite character image data $UGD_1$ to a new recording paper 22 different from the printed recording paper 22 to produce a first superimpose character image (not shown), similarly to the case of the intermediate transfer film 25.

In this way, since the first superimpose character image $KG1i_1$ on the ink ribbon 11 and the first superimpose character image $KGmi_1$ on the intermediate transfer film 25 are together brought into illegible condition, it is possible to ensure secrecy against the initial character image $FGi_1$ on the ink ribbon 11.

Thus, although the initial character image $FGi_1$ on the spent ink ribbon 11 has already lacked a pattern in black (BK) ink corresponding to the initial character image data $FGD_1$, the superimpose character image data as a result of overwriting becomes vague since the overwrite character image data $UGD_1$ is obtained by integrating at least two characters with respect to one initial character data. In this way, the first superimpose character image $KG1i_1$ on the ink ribbon 11 and the first superimpose character image $KGmi_1$ on the intermediate transfer film 25 are together brought into illegible condition against the initial character image $FGi_1$. Also in the thermal transfer printing apparatus 10A of FIG. 2, of course, the first superimpose character image (not shown) transferred onto a new recording paper 22 different from the printed paper 22 is brought into illegible condition against the initial character image $FGi_1$ on the ink ribbon 11 certainly.

In order to enhance the above-mentioned illegible condition with high reliability furthermore, the operation illustrated with FIGS. 18A to 18D is recommended.

Figures 18A, 18B, 18C, 18D:
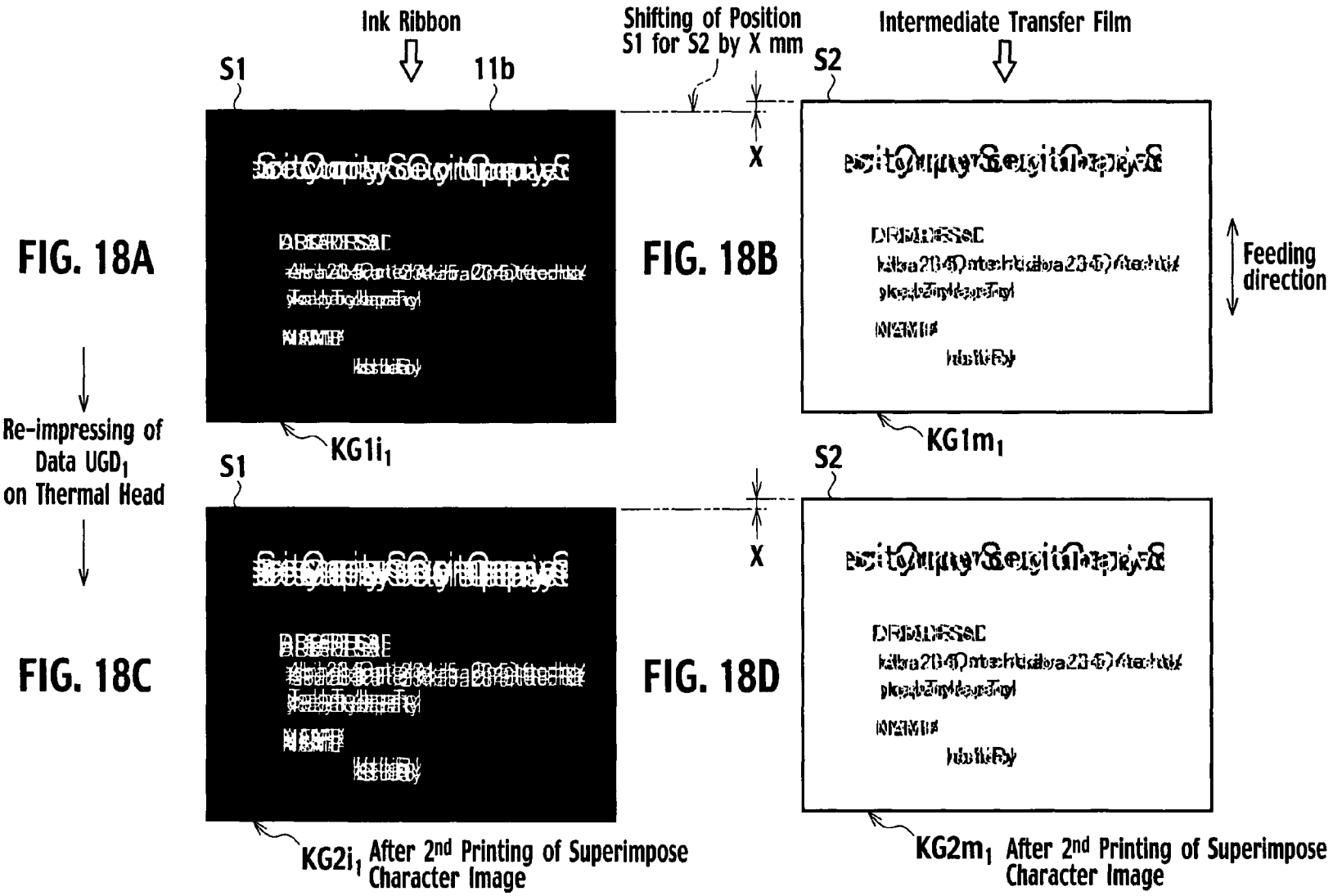
FIGS. 18A to 18D are third operational views explaining the operation of making both the initial character image printed on the ink ribbon and the superimpose character image transferred on the intermediate transfer film, illegible in the first embodiment.

After producing the first superimpose character image $KG1i_1$ on the ink ribbon 11 and the first superimpose character image $KGmi_1$ on the intermediate transfer film 25, as shown in FIGS. 4, 18A and 18B, the spent ink ribbon 11 and the spent intermediate transfer film 25 are rewound onto the supply reel 13 and the supply reel 27 in order to cue the ribbon 11 and the film 25 through the first sensor 18 and the second sensor 31, respectively. Further, while counting of the number of pulses of the pulse generator 17 connected to the guide roller 16 in the vicinity of the outlet of the supply reel 13 of the ink ribbon 11, both the ribbon 11 and the film 25 are fed under condition that the forefront position S1 of the ink layer 11*b* (BK) of the ribbon 11 is shifted from the forefront position S2 of the color image frame of the film 25 by a predetermined length (X mm).

Then, the shift value (Y mm) of the ink ribbon 11 is preset to e.g. about 2~3 mm in the thermal transfer printing apparatus 10. Based on the forefront position S2 of the color image frame of the intermediate transfer film 25, the ink ribbon 11 and the intermediate transfer film 25 are laid to overlap each other while shifting the ink ribbon 11 by X mm backward or forward in the feeding direction and supplied in between the thermal head 19 and the platen roller 20.

After that, the overwrite character image data $UGD_1$ (corres. the third image data of the invention) generated by the overwrite character image data generating unit 43 (FIG. 10) is applied on the thermal head 19 again to overwrite the image data $UGD_1$ on the first superimpose character image $KG1i_1$. Consequently, as shown in FIGS. 18C and 18D, there are produced a second superimpose character image $KG2i_1$ on the ink ribbon 11 and a second superimpose character image $KG2m_1$ on the intermediate transfer film 25 while the ink ribbon 11 is being shifted from the film 25 by X mm.

Since the second superimpose character image $KG2i_1$ on the ink ribbon 11 and the second superimpose character image $KG2m_1$ on the intermediate transfer film 25 become more illegible than first superimpose character image $KG1i_1$ and the first superimpose character image $KG1m_1$ with high reliability, it is possible to ensure the secrecy for the initial character image $FGi_1$ on the ink ribbon 11 furthermore.

Next, a modification of the first embodiment will be described with reference to FIGS. 19A to 19C.

Figure 19A:
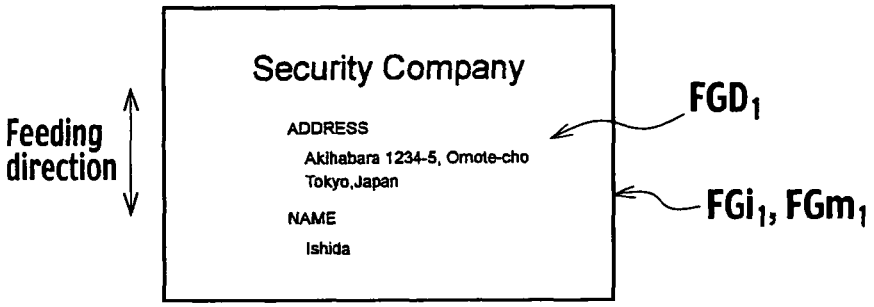
FIGS. 19A, 19B and 19C are operational views explaining a modification of the first embodiment.

In this modification of the first embodiment, as shown in FIG. 19A, by printing the initial character image data $FGD_1$, there are produced initial character images $FGi_1$, $FGm_1$ on the ink ribbon 11 and the intermediate transfer film 25, respectively. The modification is different from the first embodiment in the method of generating the overwrite character image data by processing the initial character image data $FGD_1$ after re-transferring the initial character image $FGm_1$ to the card 35.

Figure 19B:
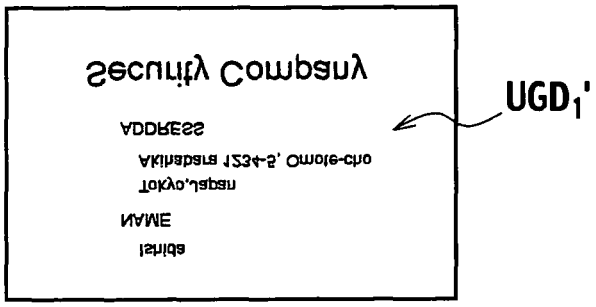
Figure 19C:
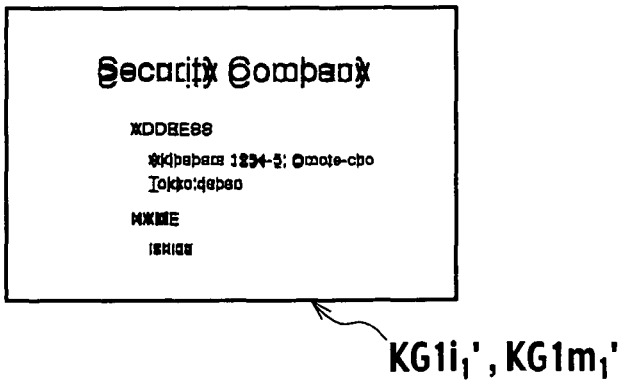

Here, as shown in FIG. 19B, the overwrite character image data $UGD_1'$ (the second image data) is produced by first detecting character areas from the initial character image data $FGD_1$ (the first image data) and successively reversing these character areas.

After that, when overwriting the overwrite character image data $UGD_1'$ on the initial character images $FGi_1$, $FGm_1$ on the ink ribbon 11 and the intermediate transfer film 25, there are produced a first superimpose character image $KG1i_1'$ on the ink ribbon 11 and a first superimpose character image $KG1m_1'$ on the intermediate transfer film 25.

Consequently, as the first superimpose character image $KG1i_1'$ on the ink ribbon 11 and the first superimpose character image $KG1m_1'$ on the intermediate transfer film 25 are brought into illegible condition, than first superimpose character image $KG1i_1$ and the second superimpose character image $KG1m_1$ with high reliability, it is possible to ensure the secrecy for the initial character image $FGi_1$ on the ink ribbon 11.

Also in the modification, similarly to the first embodiment, after producing the first superimpose character images on the ink ribbon 11 and the intermediate transfer film 25, the overwrite character image data (the third image data) may be re-printed while shifting the forefront position of the ink layer (BK) of the ribbon 11 against the forefront position of the color image frame of the film 25 by a predetermined distance (=X mm). Then, the resulting second superimpose character images on the ribbon 11 and the film 25 become more illegible with high reliability although they are not shown in the figure.

In the first embodiment including the modification, the forefront position S1 of the ink layer 11*b* of the ink ribbon 11 and the forefront position S2 of the intermediate transfer film 25 are aligned with or shifted from each other. Besides, a back end position (not shown) of the ink layer 11*b* (BK) of the ink ribbon 11 in the feeding direction may be aligned with a back end position (not shown) of the color image frame of the intermediate transfer film 25 or shifted from the back end position of the film 25 by a predetermined distance.

Although the first embodiment employs the second overwrite character image data identical to the first overwrite character image data, the second overwrite character image data may be differentiated from the first overwrite character image data.

$2^{nd}$ Embodiment

The second embodiment of the present invention will be described with reference to FIGS. 20 to 26D.

Figure 20:
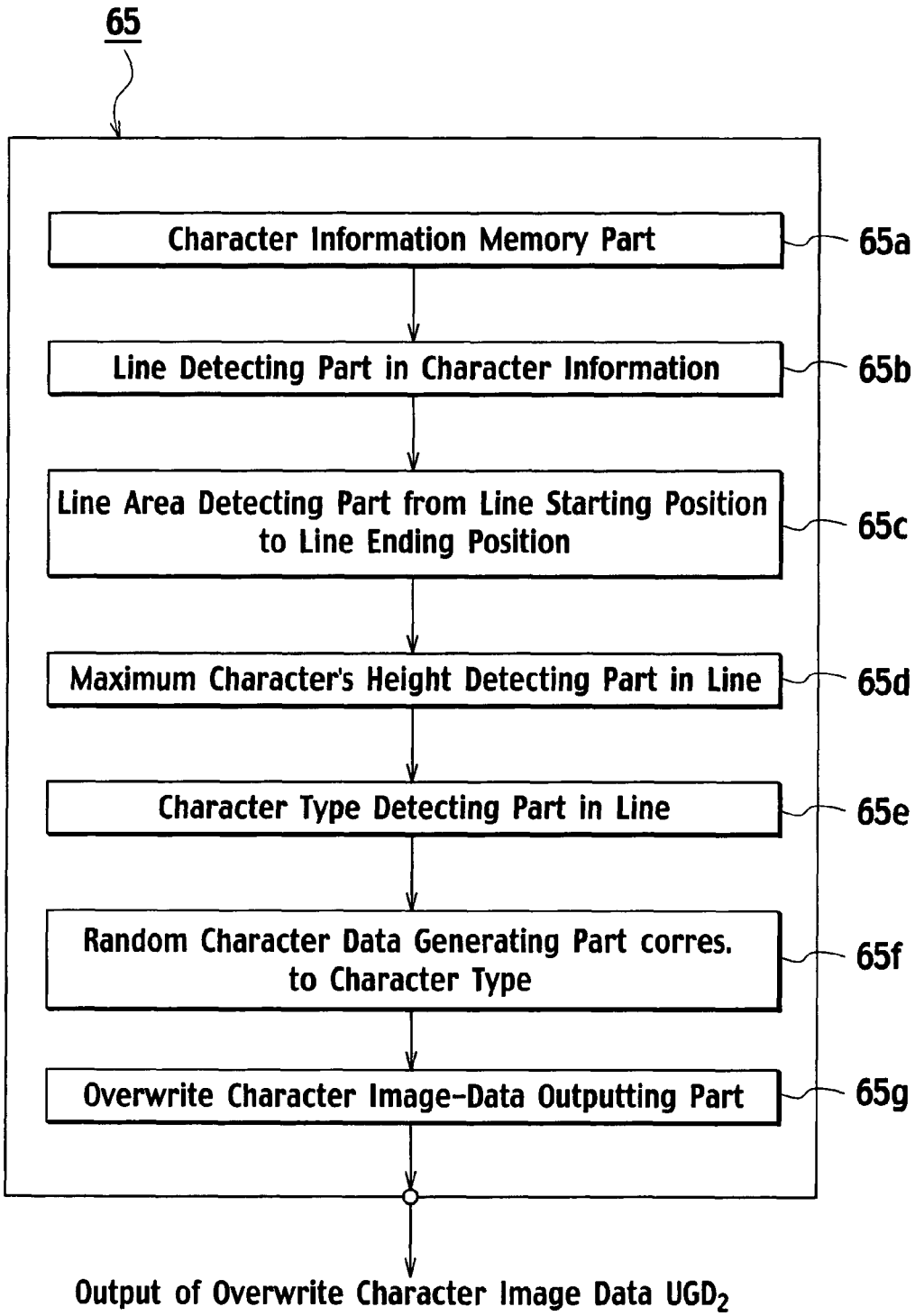
FIG. 20 is a view explaining the overwrite character image-data generating unit in accordance with the first embodiment of the present invention.

As shown in FIG. 9, the overwrite character image-data generating unit 65 of the second embodiment is arranged in the thermal transfer printing apparatus 10. FIG. 20 shows the constitution of the overwrite character image-data generating unit 65. Besides, of course, the constitution of the unit 65 is also applicable to the overwrite character image-data generating unit 43 in the personal computer 40 shown in FIG. 8 (description eliminated).

When printing initial character image data on the ink layer 11*b* in black (BK) of the ink ribbon 11 to obtain an initial character image, the overwrite character image-data generating unit 65 generates overwrite character image data for illegibility with use of random character data (data items) of the same type as characters in the initial character image data.

In detail, the overwrite character image-data generating unit 65 comprises a character information memory part 65*a* for memorizing character information contained in the print image data stored in the normal print image-data storing unit 63 (see FIG. 9), a line detecting part 65*b* for detecting a line in the character information memorized in the part 65*a*, a line area detecting part 65*c* for detecting a line area spreading from a line starting position to a line ending position, a maximum character's height detecting part 65*d* for detecting respective heights of characters printed in the line area, a character type detecting part 65*e* for detecting the type of characters printed in the line area, a random character data generating part 65*f* that generates character data (data items) corresponding to the so-detected type of characters in the line area, the numbers of generated character data items being equal to the number of characters in the line area, and an overwrite character image-data outputting part 65*g* for outputting a random-character data row as the overwrite character image data generated by the random character data generating part 65*f* to the thermal head 19.

The above-mentioned operation of the overwrite character image-data generating unit 65 will be described below. If it is judged by a user that there is important character information to be handled with high security in the print image data, it is executed to store the character information in the character information memory part 65*a*, in the form of initial character image data $FGD_2$ shown in FIG. 21.

Figure 21:
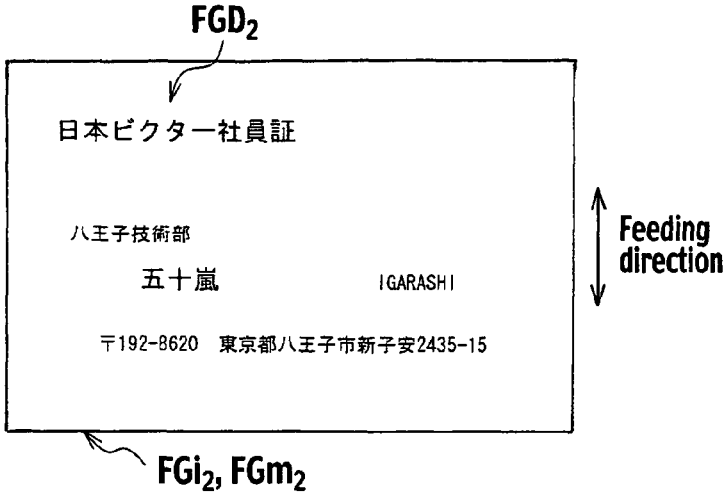
FIG. 21 is a view showing initial character image data in the overwrite character image-data generating unit of the first embodiment.

Then, the initial character image data $FGD_2$ of the second embodiment (corres. the first image data of the invention) is data which has been applied on the thermal head 19 and successively transferred from the ink layer 11*b* in black (BK) of the ink ribbon 11 (FIG. 3) to the intermediate transfer film 25. When the initial character image data $FGD_2$ is typed out onto the ink ribbon 11, the character information appears in the form of an initial character image $FGi_2$ (see FIG. 21) with outline characters in the ink layer 11*b* in black (BK). While, when the initial character image data $FGD_2$ is transferred onto the intermediate transfer film 25, the character information appears in the form of an initial character image $FGm_2$ with black characters as shown in FIG. 21.

Figure 22:
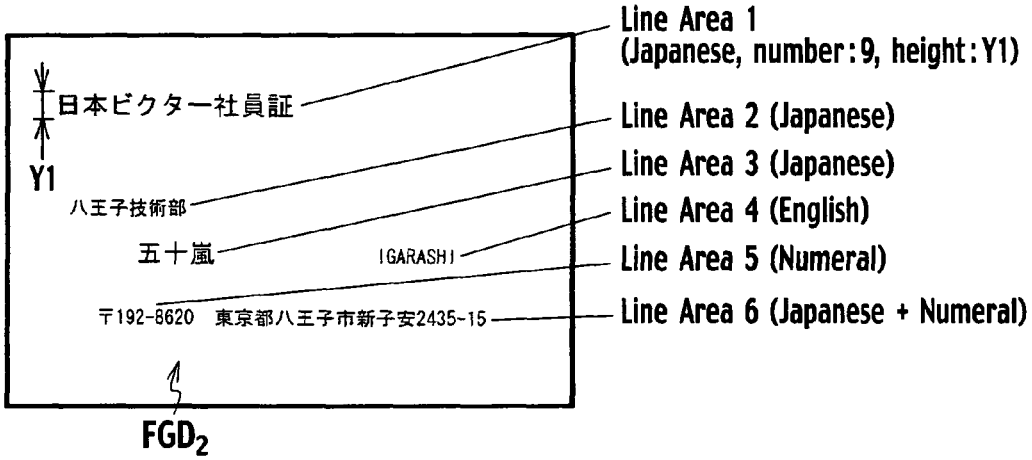
FIG. 22 is a view explaining character lines and line areas in the initial character image data in the overwrite character image-data generating unit of a second embodiment of the invention.

In the line detecting part 65*b*, it is executed to detect respective lines forming the initial character image data $FGD_2$ stored in the character information memory part 65*a*, as shown in FIG. 22. In this illustrated example, the same part 65*b* detects that the initial character image data $FGD_2$ includes six lines. After that, the line area detecting part 65*c* detects line area 1~line area 6 spreading from the line starting position to the line ending position and the number of characters printed in each line areas 1~6. Next, the maximum character's height detecting part 65*d* detects respective heights Y1, . . . (other heights: not shown) of the largest (highest) characters in the line areas 1~6.

The character type detecting part 65*e* is formed so as to detect the type of characters against the line areas 1~6 in the initial character image data $FGD_2$ shown in FIG. 22 on the ground of the character codes (kanji, kana, Roman character, etc.) standardized by e.g. JIS (Japanese Industrial Standards). In the example of FIG. 22, the unit 65*e* judges that the line areas 1~3 are composed of Japanese characters, the line area 4 English characters, the line area 5 numerals, and the line area 6 is composed of Japanese characters and numerals in mix.

Figure 23:
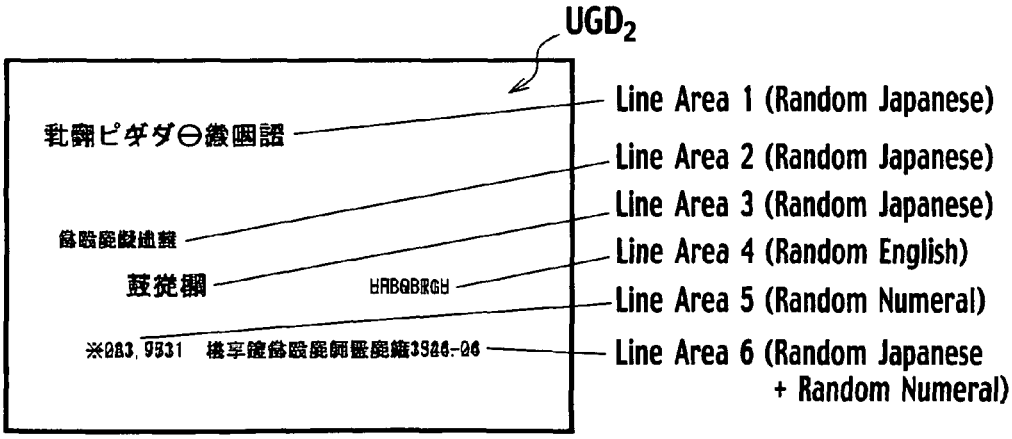
FIG. 23 is a view showing the overwrite character image data generated by the overwrite character image-data generating unit of the second embodiment.

Next, in the random character data generating part 65*f*, it is executed to generate random character data (items) of the same type as the characters detected by the character type detecting part 65*e* with respect to each line area 1~6, the number of generated data items being equal to at least the number of characters in each line area Further, the same type of random character data row with respect to each line area 1~6 is modified so as to have a height equal to the character height Y1~of each line area 1~6 to produce overwrite character image data $UGD_2$ (corres. the second image data of the invention) having a character image pattern different from that of the initial character image data $FGD_2$ (FIG. 21), as shown in FIG. 23. The resulting overwrite character image data $UGD_2$ is outputted from the overwrite character image-data outputting part 65*g*.

Note that the overwrite character image data $UGD_2$ of FIG. 23 does not include the initial character image data $FGD_2$ at all. For example, the overwrite character image data $UGD_2$ is formed with a pattern to pile up two characters adjoining on both sides of the code number of one initial character (combination of one character corresponding to the code number +1 and another character corresponding to the code number −1).

In the overwrite character image data $UGD_2$ of FIG. 23, therefore, the line areas 1~3 are formed by random Japanese character data rows for the initial Japanese character data rows (see the line areas 1~3 of FIG. 22), the line area 4 a random English character data row for the initial English character row, the line area 5 a random numeral data row for the initial numeral data row, and the line area 6 is formed by both a random Japanese character data row and a random numeral data row for the initial Japanese character data rows and the initial numeral data row.

The operation of the thermal transfer printing apparatus performing the operation of the second embodiment will be described with reference to FIG. 4 and FIGS. 24A to 26D.

Figures 24A, 24B, 24C:
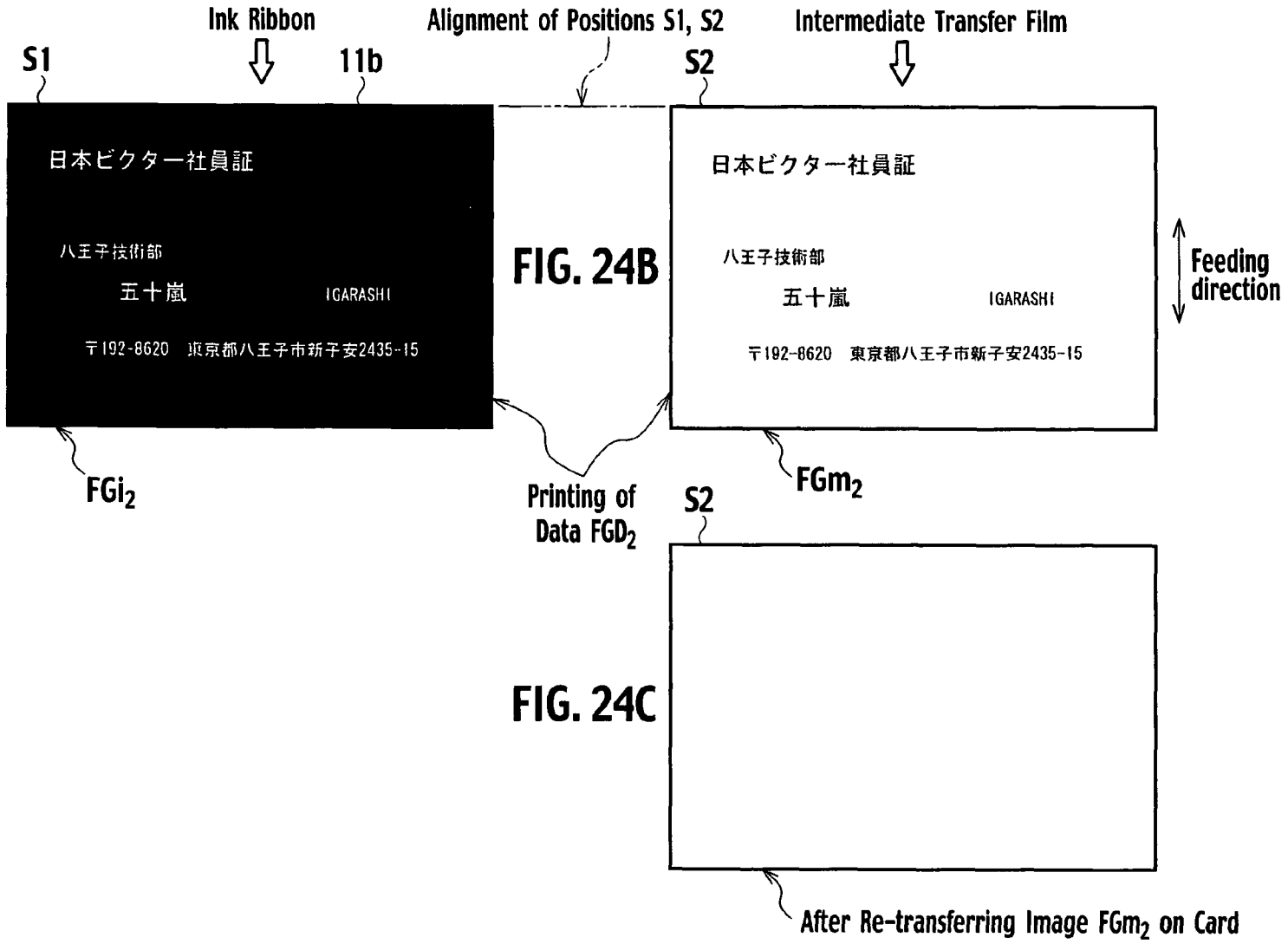
FIGS. 24A, 24B and 24C are first operational views explaining the operation of making both the initial character image printed on the ink ribbon and the superimpose character image transferred on the intermediate transfer film, illegible in the second embodiment.

First, as shown in FIGS. 4, 24A and 24B, with the drive of the controller 61 (FIG. 9), the first sensor 18 detects the cueing marks lid (FIG. 3) in black (BK) of the unspent ink ribbon 11, while the second sensor 31 detects the cueing mark 25*d* (FIG. 5) in the color image frame of the unused intermediate transfer film 25. Upon detecting these cueing marks, the ink ribbon 11 and the intermediate transfer film 25 are fed so that the forefront position S1 of the ink ribbon 11 is aligned with the forefront position S2 of the unused transfer film 25 between the thermal head 19 and the platen roller 20.

After that, the initial character image data $FGD_2$ (FIG. 21) is applied on the thermal head 19 on condition of laying the ribbon 11 on the film 25. Consequently, there are obtained the initial character image $FGi_2$ on the ink layer 11*b* (BK) of the ink ribbon 11 and the initial character image $FGm_2$ on the intermediate transfer film 25.

As shown in FIG. 24C, when re-transferring the initial character image $FGm_2$ on the film 25 to the card 35, the image $FGm_1$ is removed from the film 25, so that the film base 25*a* (FIG. 3) only is exposed to outside.

Since the initial character image $FGi_2$ on the ink ribbon 11 has important character information to be handled with high security, it is necessary to make the same image $FGi_2$ illegible. On the contrary, it is unnecessary to make the initial character image $FGm_2$ transferred to the intermediate transfer film 25 illegible since the same image $FGm_2$ will be re-transferred onto the card 35.

Figures 25A, 25B, 25C, 25D:
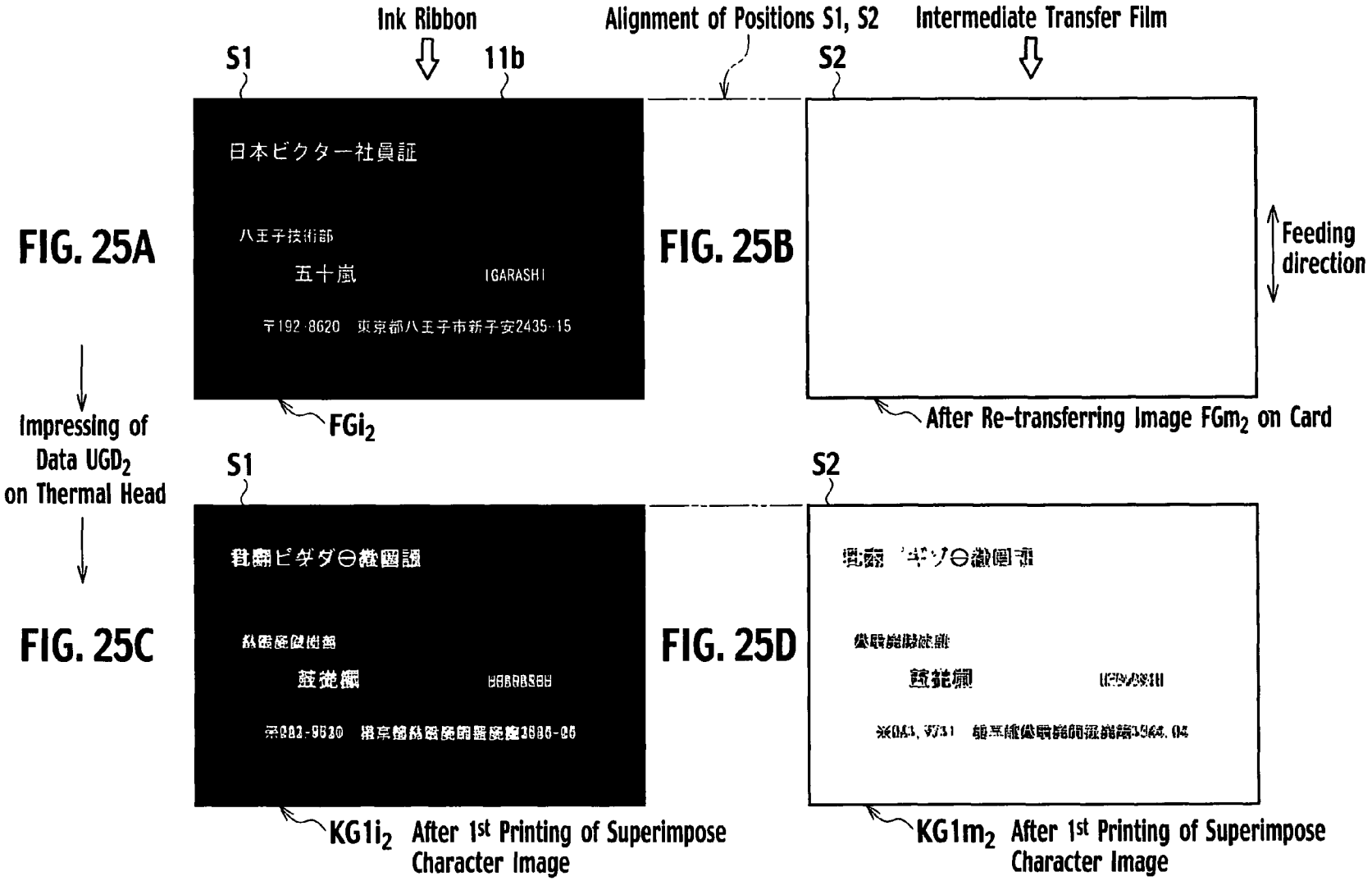
FIGS. 25A to 25D are second operational views explaining the operation of making both the initial character image printed on the ink ribbon and the superimpose character image transferred on the intermediate transfer film, illegible in the second embodiment.

Thus, after printing the initial character image $FGi_2$ onto the ink ribbon 11 and additionally re-transferring the initial character image $FGm_2$ on the intermediate transfer film 25 onto the card 35, the used ink ribbon 11 is rewound to the supply reel 13 to allow the first sensor 18 to detect the cueing marks lid of the ribbon 11, while the used intermediate transfer film 25 is rewound to the supply reel 27 to allow the second sensor 31 to detect the cueing mark 25*d* of the color image frame on the used film 25, as shown in FIGS. 4, 25A and 25B.

Then, on condition of aligning the forefront position S1 of the ink layer 11*b* (BK) of the used ink ribbon 11 with the forefront position S2 of the used intermediate transfer film 25, they (the ribbon 11, the film 25) are laid to overlap each other and further supplied in between the thermal head 19 and the platen roller 20.

After that, using the random character data rows having characters of the same type as those in the line areas 1~6, the overwrite character image-data generating unit 65 of the second embodiment (FIG. 20) generates the overwrite character image data $UGD_2$ having a character image pattern different from that of the initial character image data $FGD_2$ (FIG. 21), as shown in FIG. 23. Then, the so-generated overwrite character image data $UGD_2$ is applied on the thermal head 19 to overwrite the same data $UGD_2$ on the initial character image $FGi_2$ printed on the ink layer 11*b* (BK) of the ink ribbon 11. Consequently, there are obtained a first superimpose character image $KG1i_2$ on the ink ribbon 11 and a first superimpose character image $KG1m_2$ on the intermediate transfer film 25, as shown in FIGS. 25C and 25D.

By the way, when overwriting the overwrite character image data $UGD_2$ on the initial character image $FGi_2$ on the ink ribbon 11 in the thermal transfer printing apparatus 10A of FIG. 2, it has only to transfer the overwrite character image data $UGD_2$ to a new recording paper 22 different from the printed recording paper 22 to produce a first superimpose character image (not shown), similarly to the case of the intermediate transfer film 25.

In this way, since the first superimpose character image $KG1i_2$ on the ink ribbon 11 and the first superimpose character image $KGmi_2$ on the intermediate transfer film 25 are together brought into illegible condition, it is possible to ensure secrecy against the initial character image $FGi_2$ on the ink ribbon 11.

Thus, although the initial character image $FGi_2$ on the spent ink ribbon 11 has already lacked a pattern in black (BK) ink corresponding to the initial character image data $FGD_2$, the superimpose character image data as a result of overwriting becomes vague since the overwrite character image data $UGD_2$ is formed by the random character data having characters of the same type as those in each line area. In this way, the first superimpose character image $KG1i_2$ on the ink ribbon 11 and the first superimpose character image $KGmi_2$ on the intermediate transfer film 25 are together brought into illegible condition against the initial character image $FGi_2$. Also in the thermal transfer printing apparatus 10A of FIG. 2, of course, the first superimpose character image (not shown) transferred onto a new recording paper 22 different from the printed paper 22 is brought into illegible condition against the initial character image $FGi_2$ on the ink ribbon 11 certainly.

In order to enhance the above-mentioned illegible condition with high reliability furthermore, the following operation illustrated with FIGS. 26A to 26D is recommended.

Figures 26A, 26B, 26C, 26D:
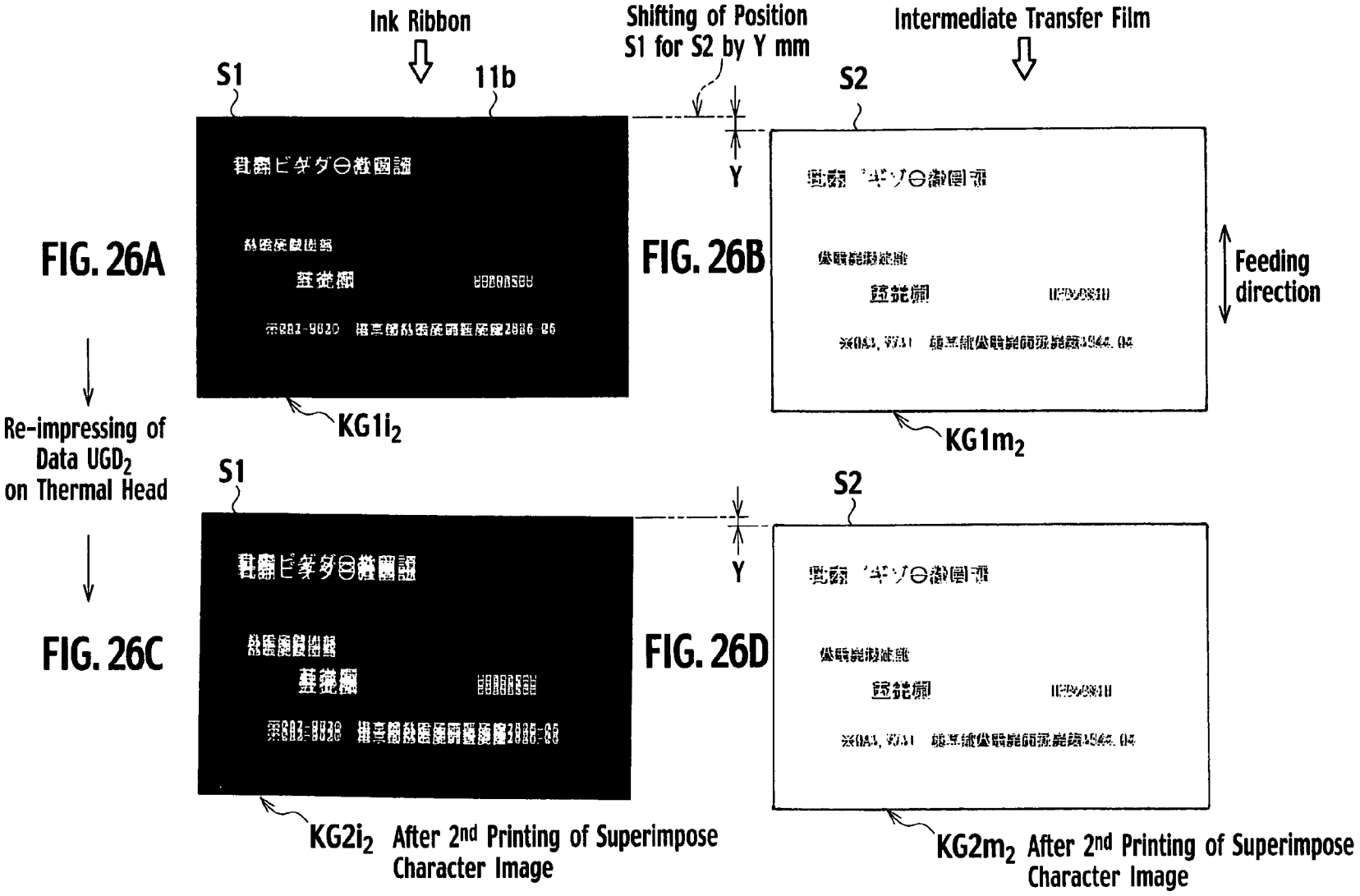
FIGS. 26A to 26D are third operational views explaining the operation of making both the initial character image printed on the ink ribbon and the superimpose character image transferred on the intermediate transfer film, illegible in the second embodiment.

After producing the first superimpose character image $KG1i_2$ on the ink ribbon 11 and the first superimpose character image $KGmi_2$ on the intermediate transfer film 25, as shown in FIGS. 4, 26A and 26B, the spent ink ribbon 11 and the spent intermediate transfer film 25 are rewound onto the supply reel 13 and the supply reel 27 in order to cue the ribbon 11 and the film 25 through the first sensor 18 and the second sensor 31, respectively. Further, while counting of the number of pulses of the pulse generator 17 connected to the guide roller 16 in the vicinity of the outlet of the supply reel 13 of the ink ribbon 11, both the ribbon 11 and the film 25 are fed under condition that the forefront position S1 of the ink layer 11*b*

(BK) of the ribbon 11 is shifted from the forefront position S2 of the color image frame of the film 25 by a predetermined length (Y mm).

Then, the shift value (Y mm) of the ink ribbon 11 is preset to e.g. about 2~3 mm in the thermal transfer printing apparatus 10. Based on the forefront position S2 of the color image frame of the intermediate transfer film 25, the ink ribbon 11 and the intermediate transfer film 25 are laid to overlap each other while shifting the ink ribbon 11 by Y mm backward or forward in the feeding direction and supplied in between the thermal head 19 and the platen roller 20.

After that, the overwrite character image data $UGD_2$ (corres. the third image data of the invention) generated by the overwrite character image-data generating unit 65 (FIG. 20) is applied on the thermal head 19 again to overwrite the image data $UGD_2$ on the first superimpose character image KG1$i_2$. Consequently, as shown in FIGS. 26C and 26D, there are produced a second superimpose character image KG2$i_2$ on the ink ribbon 11 and a second superimpose character image KG2$m_2$ on the intermediate transfer film 25 while the ink ribbon 11 is being shifted from the film 25 by Y mm.

Since the second superimpose character image KG2$i_2$ on the ink ribbon 11 and the second superimpose character image KG2$m_2$ on the intermediate transfer film 25 become more illegible with high reliability than first superimpose character image KG1$i_2$ and the second superimpose character image KG1$m_2$, it is possible to ensure the secrecy for the initial character image $FGi_1$ on the ink ribbon 11 furthermore.

In the second embodiment including the modification, the forefront position S1 of the ink layer 11*b* of the ink ribbon 11 and the forefront position S2 of the intermediate transfer film 25 are aligned with or shifted from each other. Besides, a back end position (not shown) of the ink layer 11*b* (BK) of the ink ribbon 11 in the feeding direction may be aligned with a back end position (not shown) of the color image frame of the intermediate transfer film 25 or shifted from the back end position of the film 25 by a predetermined distance.

Although the second embodiment also employs the second overwrite character image data identical to the first overwrite character image data, the second overwrite character image data may be differentiated from the first overwrite character image data.

3rd Embodiment

The third embodiment of the present invention will be described with reference to FIGS. 27 to 31D.

Figure 27:
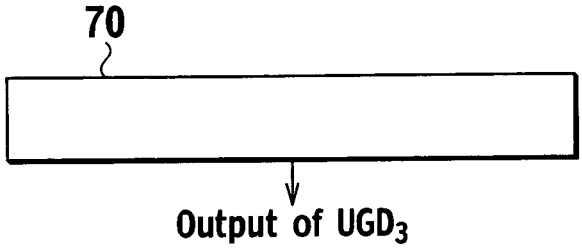
FIG. 27 is a view explaining the overwrite image-data generating unit in accordance with the third embodiment of the present invention.

In the third embodiment, the overwrite character image-data generating unit 43 in the personal computer 40 of FIG. 8 or the overwrite character image-data generating unit 65 in the thermal transfer printing apparatus 10 of FIG. 9 is replaced with the overwrite character image-data generating unit 70 of FIG. 27.

When printing initial character image data (corres. the first image data of the invention) on the ink layer 11*b* in black (BK) of the ink ribbon 11 to obtain the initial character image, the overwrite character image-data generating unit 70 operates to generate overwrite image data by arranging binarized information of "0" and "1" in a predetermined pattern different from the initial character image data without using any character data.

Figure 28A:
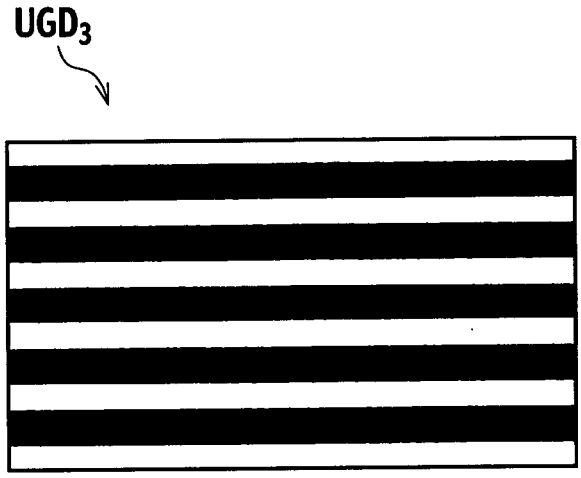
Figure 28B:
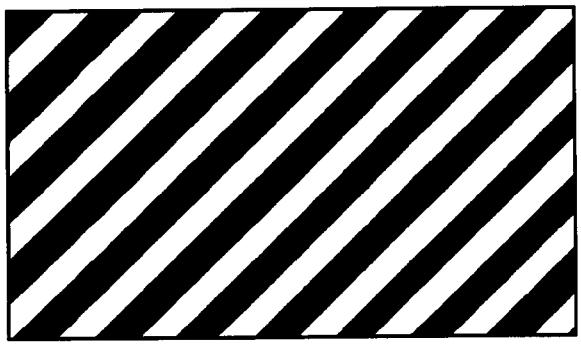
Figure 28C:
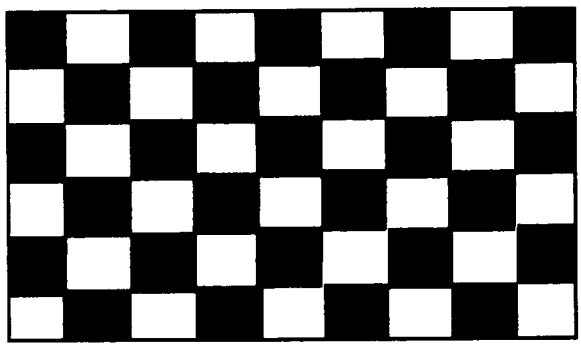

More concretely, when arranging the binarized information of "0" and "1" in the predetermined pattern to generate overwrite image data $UGD_3$ (corres. the second image data of the invention), the overwrite character image-data generating unit 70 of the third embodiment adopts any one of a horizontal stripe pattern of FIG. 28A, an oblique stripe pattern of FIG. 28B and a known check pattern of FIG. 28C. Note that the horizontal stripe pattern of FIG. 28A comprises a plurality of white bands corresponding to "0" and a plurality of black bands corresponding to "1" all extending along the main scan direction of the thermal head 19 (see FIG. 7) and alternately in the sub-scan direction of the head 19. The oblique stripe pattern of FIG. 28B is obtained by slanting a band-shaped black-and-white pattern to the main scan direction of the head 19 at a predetermined angle.

In the illustrated example, the overwrite character image-data generating unit 70 of the third embodiment outputs the horizontal pattern of FIG. 28A as the overwrite image data $UGD_3$. Here, the operation of the thermal transfer printing apparatus performing the operation of the first embodiment will be described with reference to FIG. 4 and FIGS. 29A to 31D.

Figures 29A, 29B, 29C:
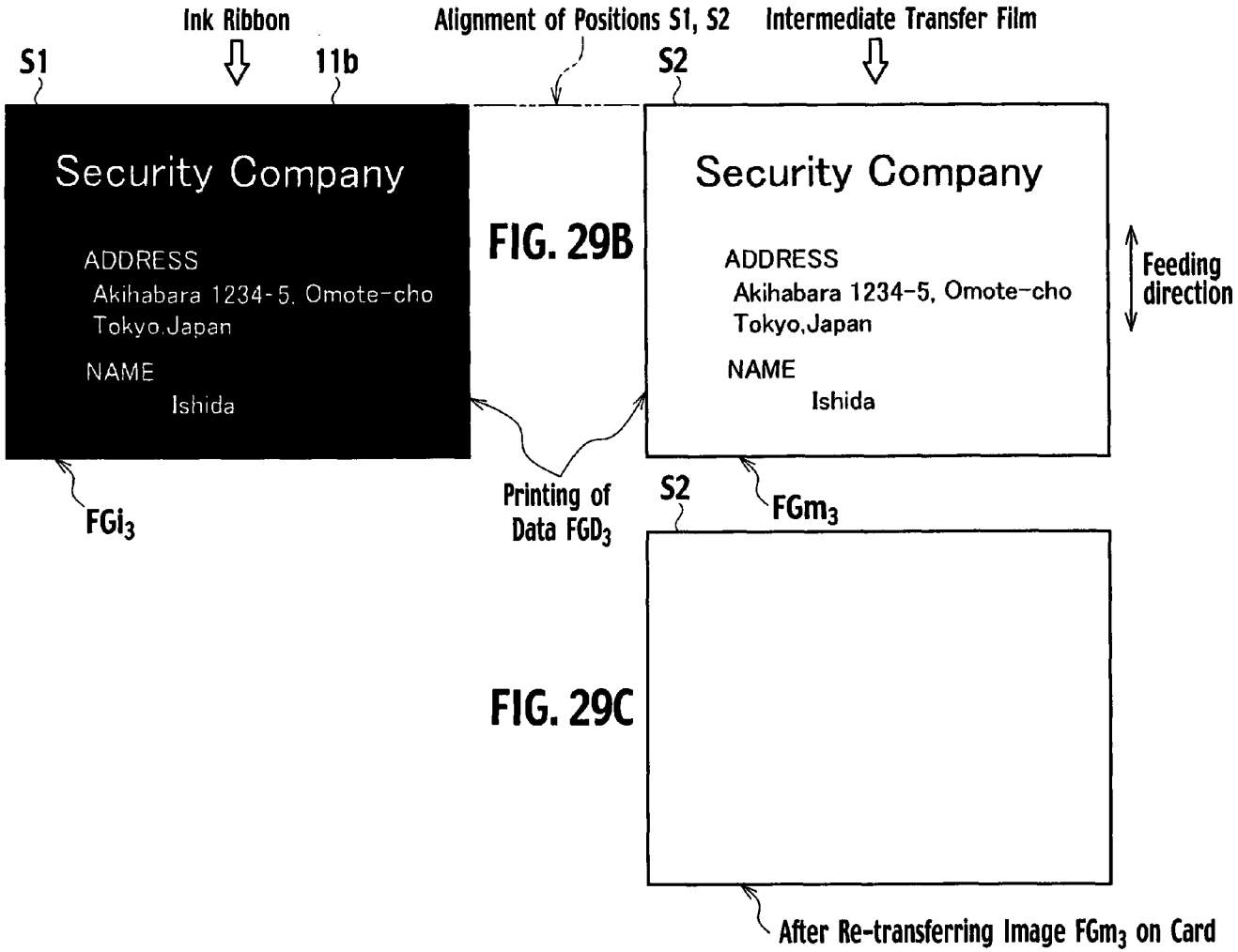
FIGS. 29A, 29B and 29C are first operational views explaining the operation of making both the initial character image printed on the ink ribbon and the superimpose character image transferred on the intermediate transfer film, illegible in a third embodiment.

First, as shown in FIGS. 4, 29A and 29B, with the drive of the controller 51 (FIG. 8) or 61 (FIG. 9), the first sensor 18 detects the cueing marks 11*d* (FIG. 3) in black (BK) of the unspent ink ribbon 11, while the second sensor 31 detects the cueing mark 25*d* (FIG. 5) in the color image frame of the unused intermediate transfer film 25. Upon detecting these cueing marks, the ink ribbon 11 and the intermediate transfer film 25 are fed so that the forefront position S1 of the ink ribbon 11 (i.e. one end of the ink layer 11*b* in BK in the feeding direction) is aligned with the forefront position S2 of the unused transfer film 25 (i.e. one end of the color image frame in the feeding direction) between the thermal head 19 and the platen roller 20.

After that, the initial character image data $FGD_3$ having the same pattern as that of the first embodiment is applied on the thermal head 19 on condition of laying the ribbon 11 on the film 25. Consequently, there are obtained the initial character image $FGi_3$ on the ink layer 11*b* (BK) of the ink ribbon 11 and the initial character image $FGm_3$ on the intermediate transfer film 25.

As shown in FIG. 29C, when re-transferring the initial character image $FGm_3$ on the film 25 to the card 35, the image $FGm_3$ is removed from the film 25, so that the film base 25*a* (FIG. 3) only is exposed to outside.

Since the initial character image $FGi_3$ on the ink ribbon 11 has important character information to be handled with high security, it is necessary to make the same image $FGi_3$ illegible. On the contrary, it is unnecessary to make the initial character image $FGm_3$ transferred to the intermediate transfer film 25 illegible since the same image $FGm_3$ will be re-transferred onto the card 35.

Thus, after printing the initial character image $FGi_3$ onto the ink ribbon 11 and additionally re-transferring the initial character image $FGm_3$ on the intermediate transfer film 25 onto the card 35, the spent ink ribbon 11 is rewound to the supply reel 13 to allow the first sensor 18 to detect the cueing marks 11*a* of the ribbon 11, as shown in FIGS. 4 and 30A. Simultaneously, the spent intermediate transfer film 25 is also rewound to the supply reel 27 to allow the second sensor 31 to detect the cueing mark 25*d* of the color image frame on the used film 25, as shown in FIGS. 4 and 30B. In this way, under condition that the forefront position S1 of the ink layer 11*b* (BK) of the used ink ribbon 11 is aligned with the forefront position S2 of the used intermediate transfer film 25 between the thermal head 19 and the platen roller 20, they (the ribbon 11, the film 25) are laid to overlap each other and further supplied in between the thermal head 19 and the platen roller 20.

After that, the overwrite character image-data generating unit 70 of the third embodiment (FIG. 27) generates the overwrite character image data $UGD_3$ having the horizontal stripe pattern, as shown in FIG. 28A. Then, the so-generated overwrite character image data $UGD_3$ is applied on the thermal head 19 to overwrite the same data $UGD_3$ on the initial character image $FGi_3$ printed on the ink layer 11*b* (BK) of the ink ribbon 11. Consequently, there are obtained a first superimpose character image KG1$i_3$ on the ink ribbon 11 and a first superimpose character image KG1$m_3$ on the intermediate transfer film 25, as shown in FIGS. 30C and 30D.

By the way, when overwriting the overwrite character image data $UGD_3$ on the initial character image $FGi_3$ on the ink ribbon 11 in the thermal transfer printing apparatus 10A of FIG. 2, it has only to transfer the overwrite character image data $UGD_3$ to a new recording paper 22 different from the printed recording paper 22 to produce a first superimpose character image (not shown), similarly to the case of the intermediate transfer film 25.

In this way, since the first superimpose character image KG1$i_3$ on the ink ribbon 11 and the first superimpose character image $KGmi_3$ on the intermediate transfer film 25 together contain the overwrite image data $UGD_3$ having the band-shaped horizontal stripe pattern in black and white different from the first and second embodiments, the images KG1$i_3$, $KGmi_3$ are brought into illegible condition by halves.

In order to make the remaining halves of the first superimpose character images KG1$i_3$, $KGmi_3$, therefore, the following operation illustrated with FIGS. 31A to 31D is recommended.

Figures 31A, 31B, 31C, 31D:
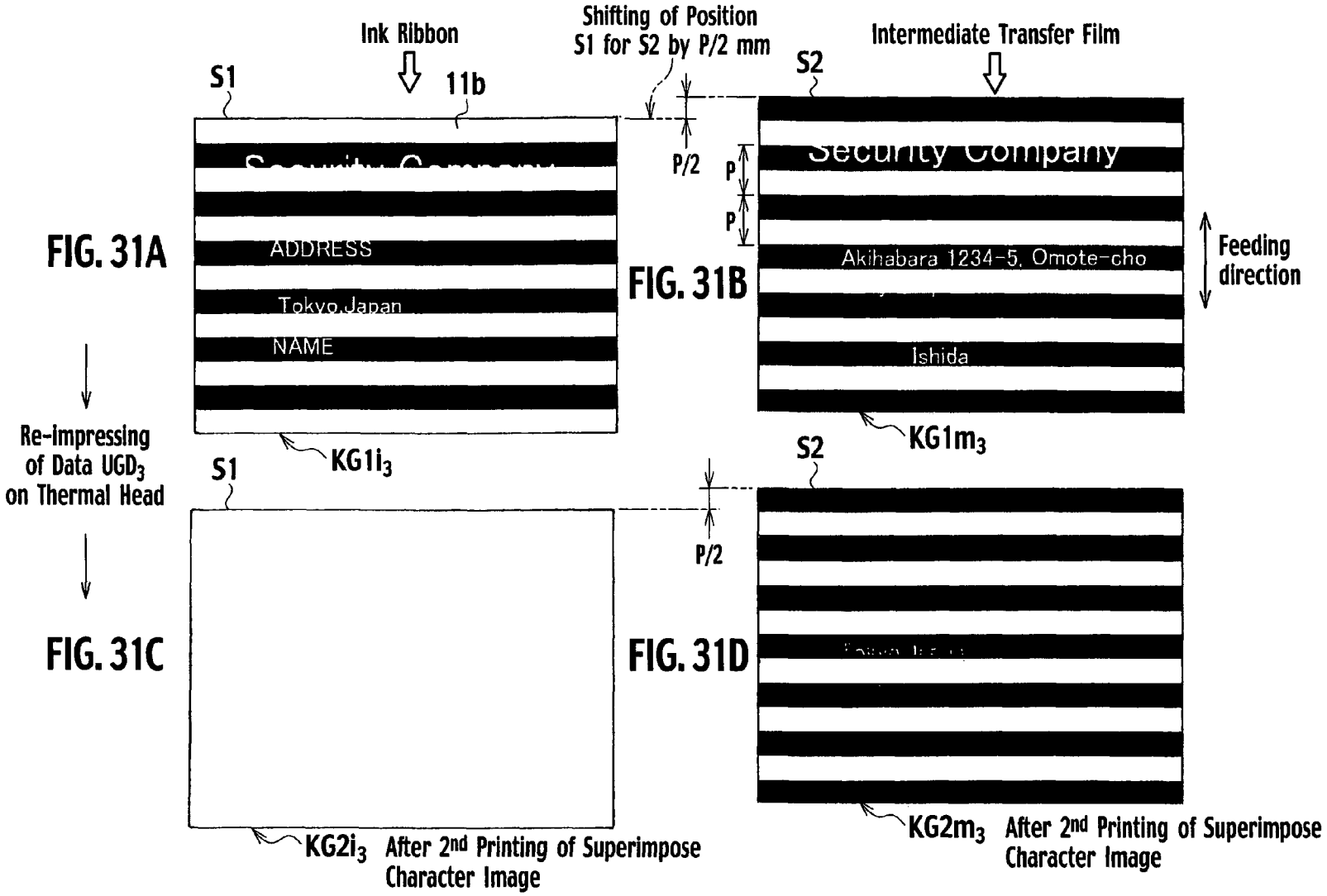
FIGS. 31A to 31D are third operational views explaining the operation of making both the initial character image printed on the ink ribbon and the superimpose character image transferred on the intermediate transfer film, illegible in the third embodiment.

After producing the first superimpose character image KG1$i_3$ on the ink ribbon 11 and the first superimpose character image $KGmi_3$ on the intermediate transfer film 25, as shown in FIGS. 4, 31A and 31B, the spent ink ribbon 11 and the spent intermediate transfer film 25 are rewound onto the supply reel 13 and the supply reel 27 in order to cue the ribbon 11 and the film 25 through the first sensor 18 and the second sensor 31, respectively. Further, while counting of the number of pulses of the pulse generator 17 connected to the guide roller 16 in the vicinity of the outlet of the supply reel 13 of the ink ribbon 11, both the ribbon 11 and the film 25 are fed under condition that the forefront position S1 of the ink layer 11*b* (BK) of the ribbon 11 is shifted from the forefront position S2 of the color image frame of the film 25 by a predetermined length (P/2 mm).

Then, the shift value (P/2 mm) of the ink ribbon 11 is preset to one half of a pitch (P mm) defining one pair of black-and-white bands. Based on the forefront position S2 (datum point) of the color image frame of the intermediate transfer film 25, the ink ribbon 11 and the intermediate transfer film 25 are laid to overlap each other while shifting the ink ribbon 11 by P/2 mm backward or forward in the feeding direction and supplied in between the thermal head 19 and the platen roller 20.

After that, the overwrite character image data $UGD_3$ (corres. the third image data of the invention) generated by the overwrite character image-data generating unit 70 (FIG. 27) is applied on the thermal head 19 again to overwrite the image data $UGD_3$ on the first superimpose character image KG1$i_3$ on the ink ribbon 11. Consequently, as shown in FIGS. 31C and 31D, there are produced a second superimpose character image KG2$i_3$ on the ink ribbon 11 and a second superimpose character image KG2$m_3$ on the intermediate transfer film 25 while the ink ribbon 11 is being shifted from the film 25 by P/2 mm. Then, as shown in FIG. 31C, the second superimpose character image KG2$i_3$ on the ink ribbon 11 is brought into a condition to expose only the ribbon base 11*a* (FIG. 3) since the overwrite the image data $UGD_3$ having the horizontal stripe pattern has been overwritten on the ribbon 11 in twice with the shifting of P/2 mm.

Different from the first and second embodiments, according to the third embodiment, there are adopted the second overwrite image data (band-shaped black-and-white pattern) identical to the first overwrite image data.

Further, since the second superimpose character image KG2$i_3$ on the ink ribbon 11 and the second superimpose character image KG2$m_3$ on the intermediate transfer film 25 are together brought into illegible condition, it is possible to ensure the secrecy for the initial character image $FGi_3$ on the ink ribbon 11.

In the third embodiment, the forefront position S1 of the ink layer 11*b* of the ink ribbon 11 and the forefront position S2 of the intermediate transfer film 25 are aligned with or shifted from each other. Besides, a back end position (not shown) of the ink layer 11*b* (BK) of the ink ribbon 11 in the feeding direction may be aligned with a back end position (not shown) of the color image frame of the intermediate transfer film 25 or shifted from the back end position of the film 25 by a predetermined distance.

Finally, it will be understood by those skilled in the art that the foregoing descriptions are nothing but embodiments and various modifications of the disclosed thermal transfer printing method and apparatus and therefore, various changes and modifications may be made within the scope of claims.

What is claimed is:

1. A thermal transfer printing method comprising the steps of:

opposing a first area in an ink ribbon having an ink layer to a second area in a first transferred object so that an end of the first area in a feeding direction of the ink ribbon is aligned with an end of the second area in the first transferred object in a feeding direction thereof;

applying first image data having either characters or graphics on a thermal head while feeding the ink ribbon and the first transferred object under a condition that the ink ribbon and the first transferred object are overlapped on each other to transfer the ink layer in the first area of the ink ribbon to the second area of the first transferred object thereby forming a first image based on the first image data in the second area of the transferred object;

opposing the second area in the first transferred object to a third area in a second transferred object so that the end of the second area of the first transferred object in the feeding direction is aligned with an end of the third area of the second transferred object in a feeding direction thereof;

heating a heat roller while feeding the first transferred object and the second transferred object under a condition that the first transferred object and the second transferred object are overlapped on each other thereby transferring the first image in the second area to the third area of the second transferred object;

opposing the ink ribbon to the first transferred object so that the end of the first area in the feeding direction is aligned with the end of the second area in the feeding direction;

applying second image data having either characters or graphics on the thermal head while feeding the ink ribbon and the first transferred object under the condition that the ink ribbon and the first transferred object are overlapped on each other to transfer the ink layer in the first area to the second area of the first transferred object thereby forming a second image based on the second image data in the second area;

opposing the ink ribbon to the first transferred object so that the end of the first area in the feeding direction is shifted from the end of the second area in the feeding direction by a predetermined distance; and applying third image data having either characters or graphics for overwriting, the third image data being identical to or different from the second image data, on the thermal head while feeding the ink ribbon and the first transferred object under the condition that the ink ribbon and the first transferred object are overlapped on each other to transfer the ink layer in the first area to the second area of the first transferred object thereby forming a third image based on the third image data in the second area.

2. The thermal transfer printing method of claim 1, wherein either the second image data or the third image data is generated on a basis of the first image data.

3. The thermal transfer printing method of claim 2, wherein either the second image data or the third image data has an image pattern composed of characters or graphics different from those of the first image data.

4. The thermal transfer printing method of claim 3, wherein the image pattern is generated by random use of characters of the same type as the characters contained in the first image data.

5. The thermal transfer printing method of claim 2, wherein the second image data or the third image data is generated by the steps of:

detecting a line in the first image data;

detecting a line area spreading from a starting position of the line in the first image data to an ending position of the line;

compartmentalizing the line area into a plurality of overwrite character frames corresponding to the size of a character in the line area; and adding up character data in at least two overwrite character frames of the plurality of overwrite character frames except for an overwrite character frame to be overwritten.

6. The thermal transfer printing method of claim 2, wherein the second image data or the third image data is generated by the steps of:

detecting a line in the first image data;

detecting a line area spreading from a starting position of the line in the first image data to an ending position of the line;

detecting a type of characters in the line area; and arranging characters of the same type as the characters in the line area at random, whose number of characters arranged at random is equal to the number of characters in the line area.

7. The thermal transfer printing method of claim 1, wherein the second image data or the third image data is any one of a horizontal stripe pattern, an oblique stripe pattern and a check pattern.

* * * * *